US007589700B2

(12) United States Patent
Miyagawa

(10) Patent No.: US 7,589,700 B2
(45) Date of Patent: Sep. 15, 2009

(54) DRIVING METHOD OF DISPLAY DEVICE

(75) Inventor: Keisuke Miyagawa, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 754 days.

(21) Appl. No.: 11/187,124

(22) Filed: Jul. 22, 2005

(65) Prior Publication Data

US 2006/0028412 A1 Feb. 9, 2006

(30) Foreign Application Priority Data

Aug. 3, 2004 (JP) ..... 2004-227210

(51) Int. Cl.
*G09G 3/30* (2006.01)

(52) U.S. Cl. ..... 345/77; 345/692; 345/204; 345/82

(58) Field of Classification Search ..... 345/77, 345/204, 690, 82
See application file for complete search history.

(56) References Cited

U.S. PATENT DOCUMENTS 6,774,876 B2 8/2004 Inukai et al.
6,972,773 B2 * 12/2005 Matsui et al. ..... 345/611
7,106,290 B2 9/2006 Inukai et al.
7,283,111 B2 10/2007 Kimura
7,352,375 B2 4/2008 Yamazaki et al.
7,466,325 B2 12/2008 Miyagawa
2002/0130828 A1 9/2002 Yamazaki et al.
2005/0212740 A1 9/2005 Miyagawa
2005/0259053 A1 11/2005 Iwabuchi

* cited by examiner

*Primary Examiner*—Richard Hjerpe
*Assistant Examiner*—Leonid Shapiro
(74) *Attorney, Agent, or Firm*—Cook Alex Ltd.

(57) ABSTRACT

It is an object to provide a driving method of a semiconductor display device by which generation of pseudo contour can be suppressed while suppressing the operating frequency of a driver circuit. It is also an object to provide a driving method of a semiconductor display device by which generation of pseudo contour can be suppressed while suppressing decrease in image quality. One mode of the invention is a driving method of a semiconductor display device, wherein a set of a plurality of subframe periods is provided in one frame period and the set of the plurality of subframe periods is inverted at some point to be provided.

9 Claims, 13 Drawing Sheets

1.00s
1 2 3 4 ... 57 58 59 60

1 frame ≒ 16.67ms
SF2 SF4 SF6 SF8 SF10 SF12 SF14 SF16 SF15 SF13 SF11 SF9 SF7 SF5 SF3 SF1 SF1 SF3 SF5 SF7 SF9 SF11 SF13 SF15 SF16 SF14 SF12 SF10 SF8 SF6 SF4 SF2
DS period 1 column scanning period ( = 324 rows selection periods = 0.50ms)
001 002 003 004 005 ..... 318 319 320

DRIVING METHOD OF DISPLAY DEVICE

BACKGROUND OF THE INVENTION

1. Field of the Invention

The present invention relates to a driving method of a display device for performing a display by a time gray scale method.

2. Description of the Related Art

As a driving method of a light emitting device that is one of display devices, there is known a time gray scale method in which a light emission period of pixels in one frame period is controlled with binary voltage of a digital video signal to display a gray scale. Electroluminescent materials are more suitable for a time gray scale method than liquid crystals and the like since the response speed is generally faster. Specifically, when performing display by the time gray scale method, one frame period is divided into a plurality of subframe periods. Then, a light emitting element in a pixel emits light or not in accordance with a video signal in each subframe period. According to the aforementioned structure, the total actual light emission period of the pixels in one frame period can be controlled by a video signal, so that a gray scale can be displayed.

However, in the case of performing display using the time gray scale method, there is a problem in that a pseudo contour may be displayed in a pixel portion depending on the frame frequency. Pseudo contours are unnatural contour lines that are often perceived when the middle gray scale is displayed by the time gray scale method, which is considered to be mainly caused by a variation of the perceptual luminance due to a characteristic of human visual sense.

As a technique to prevent the above-described pseudo contour, a driving method of a plasma display has been proposed in which a subframe period for light emission appears continuously within one frame period (see Patent Document 1). According to the driving method, such a phenomenon that a light emission period and a non light emission period within each frame period are inverted in adjacent frame periods can be prevented, so that generation of pseudo contour can be suppressed.

[Patent Document 1] Japanese Patent Laid-Open No. 2000-231362 (p. 5, paragraph 0023)

However, in the driving method disclosed in Patent Document 1, the total gray scale level equals to the number of subframe periods for one frame period. Therefore, when the number of subframe periods is increased in order to increase the total gray scale level, each subframe period is required to be shortened. However, video signal input to pixels of all rows is generally required in each subframe period. Thus, in the case where the subframe period is too short, the operating frequency of a driver circuit is required to be increased. Considering the reliability of a driver circuit, it is not preferable to make a subframe period shorter than is necessary.

Note that each subframe period can be lengthened to some extent by lengthening a frame period. However, lengthening the frame period is not preferable in that drastic increase of the total gray scale level is not to be realized, besides, a flicker is to be more easily generated.

In Patent Document 1, therefore, a technique for increasing the total gray scale level to be displayed in a pseudo manner without increasing the number of subframe periods is also described, in which image processing such as dithering is performed. However, by performing the image processing such as dithering, the total gray scale level to be displayed can be increased while the image is displayed as if sand is spread thereover, leading inevitably to decrease in image quality.

SUMMARY OF THE INVENTION

In view of the foregoing problem, it is an object of the invention to provide a driving method of a display device, in which generation of pseudo contour can be suppressed while suppressing the operating frequency of a driver circuit. In addition, it is an object of the invention to provide a display device in which generation of pseudo contour can be suppressed while suppressing the decrease in image quality, and a driving method thereof.

In view of the foregoing problem, the invention provides a driving method of a display device in which a set of subframe periods is inverted at a certain point to be provided.

One specific mode of the invention is a driving method of a display device in which a set of a plurality of subframe periods is provided in one frame period, and the set of the plurality of subframe periods is inverted at a certain point to be provided.

Another mode of the invention is a driving method of a display device in which a set of a plurality of subframe periods is provided in one frame period, and the set of the plurality of subframe periods is inverted at a certain point in one frame period to be provided.

In the invention, respective lengths of the plurality of subframe periods satisfy $2^0:2^1:2^2 \ldots :2^n$ (n is a positive integer). Alternatively, in the invention, the respective lengths of the plurality of subframe periods are determined in accordance with a subframe ratio $R_{SF}$ obtained from a sharing ratio $R_{sh}$.

It is to be noted that, the display device of the invention includes a light emitting device comprising a light emitting element typified by an organic light emitting element (OLED), a liquid crystal display device, a DMD (Digital Micromirror Device), a PDP (Plasma Display Panel), an FED (Field Emission Display), and the other display devices capable of displaying by a time gray scale method. When the time gray scale method is employed in such display devices, the driving method of the invention can be applied. In addition, the light emitting device includes a panel with a light emitting element sealed, and a module where an IC and the like including a controller are mounted on the panel.

According to the above-described driving method of the invention, generation of pseudo contour can be suppressed. In addition, when the frame frequency is 60 Hz or more, preferably 90 Hz or more, it is preferable in that generation of flicker can be decreased.

DETAILED DESCRIPTION OF THE INVENTION

Figure 1A:
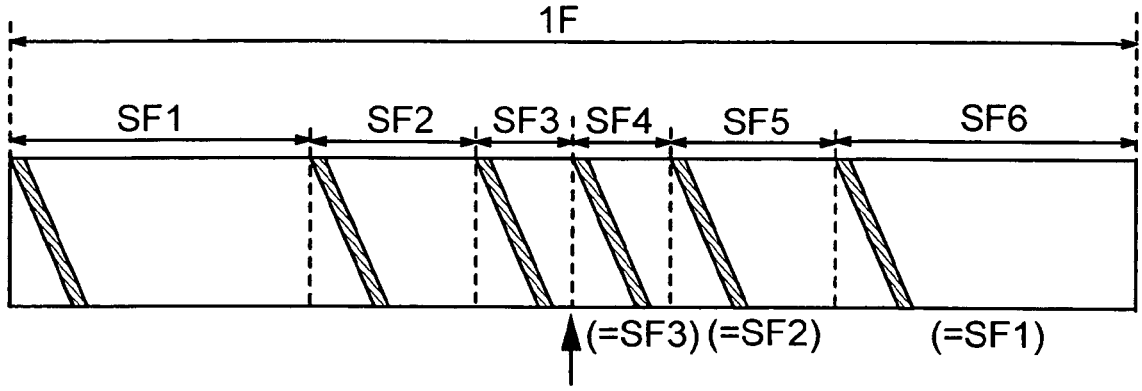
FIGS. 1A and 1B are diagrams each showing a timing chart of the invention.

Although the invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein. In the drawings for describing embodiment modes and embodiments, the same portions or portions having the same function are denoted by the same reference numerals, and the description thereof is omitted.

EMBODIMENT MODE 1

Described in this embodiment mode is a timing chart of the invention in which subframe periods are provided so as to be symmetric at a certain position in one frame period.

As shown in FIG. 1A, one frame period is divided into subframe periods SF1 to SF6 in which respective subframe period lengths of SF1 and SF6, those of SF2 and SF5, and those of SF3 and SF4 are equal to each other. That is, a set of subframe periods (SF1 to SF3) is inverted between SF3 and SF4 (at a point indicated by an arrowhead). In this embodiment mode, the point indicated by an arrowhead means a half period of the frame period. In other words, the set of the subframe periods is inverted at an end of the set of the subframe periods (SF1 to SF3).

Figure 1B:
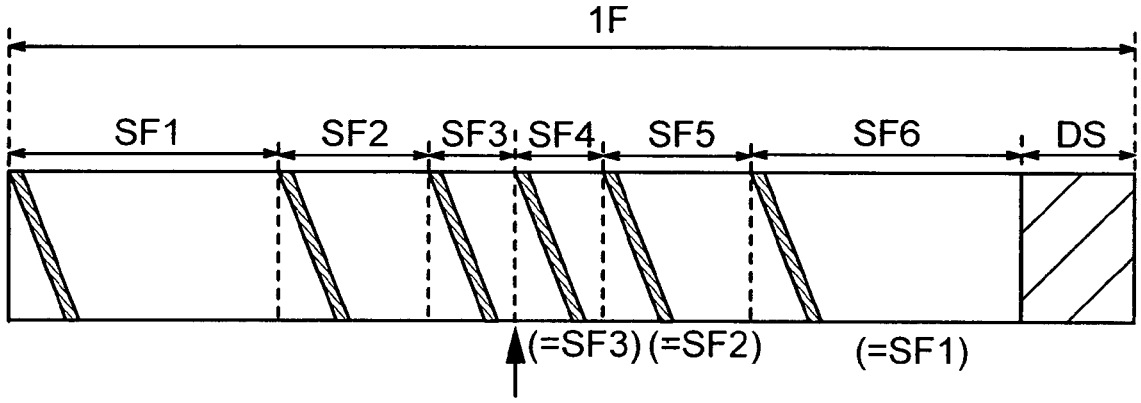

FIG. 1B is a timing chart in which a reverse-voltage applying period (DS) is provided in the timing chart in FIG. 1A. The same structure as that in FIG. 1A other than the reverse-voltage applying period (DS) is omitted to describe. By applying a reverse voltage to the light emitting element in the reverse-voltage applying period as described above, degradation state thereof is improved, leading to improvement of the reliability. The light emitting element may have an initial defect that the anode and the cathode thereof are short-circuited due to adhesion of foreign substances, some pinholes that are produced by minute projections of the anode or the cathode, or irregularity of the electroluminescent layer. Such an initial defect is eliminated by applying the reverse voltage, which leads to favorable image display. Note that the insulation of the short-circuited portion is preferably performed before shipping.

In this embodiment mode, a position at which the reverse-voltage applying period is provided is not limited to that shown in FIG. 1B. For example, it may be provided before or after each one of SF1 to SF6. In addition, in the case of applying a reverse voltage, the reverse-voltage applying period is not necessarily provided for one frame period.

As described above, a set of subframe periods is inverted at a position in one frame period according to this embodiment mode. Consequently, generation of pseudo contour can be prevented.

The number and length of subframe periods provided in a set of subframe periods are not limited to those shown in FIGS. 1A and 1B in this embodiment mode. In addition, the number of positions for inversion is not limited to one unlike FIGS. 1A and 1B, a plurality of positions may be provided.

Figure 3A:
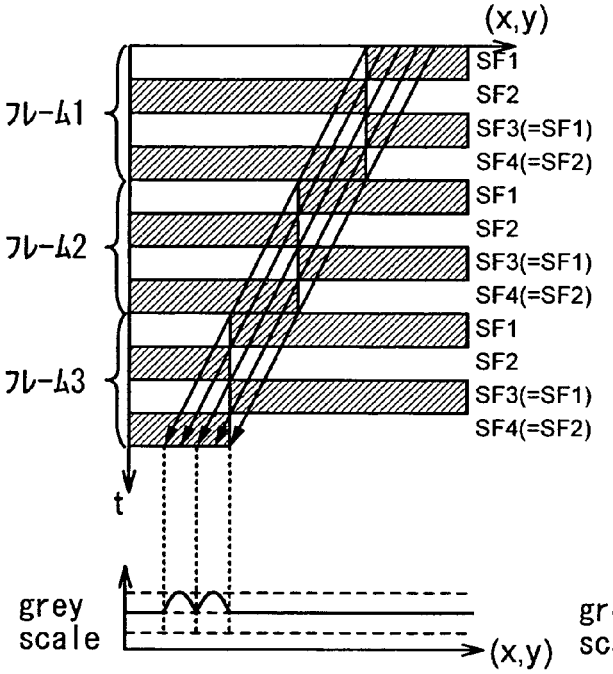
FIGS. 3A to 3D are diagrams for comparing the invention and a conventional one with each other.
Figure 3B:
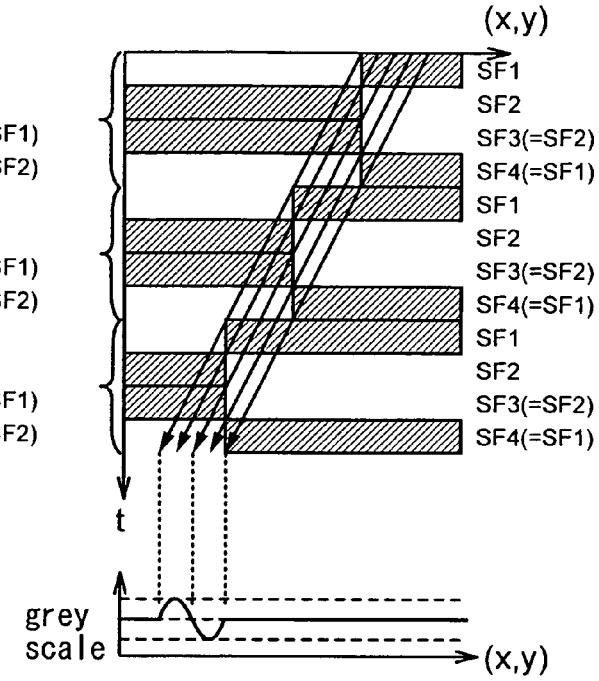
Figure 3C:
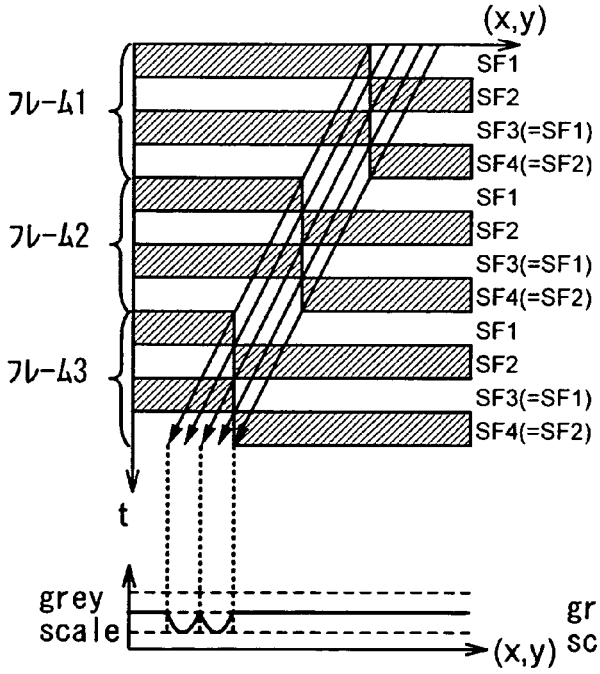
Figure 3D:
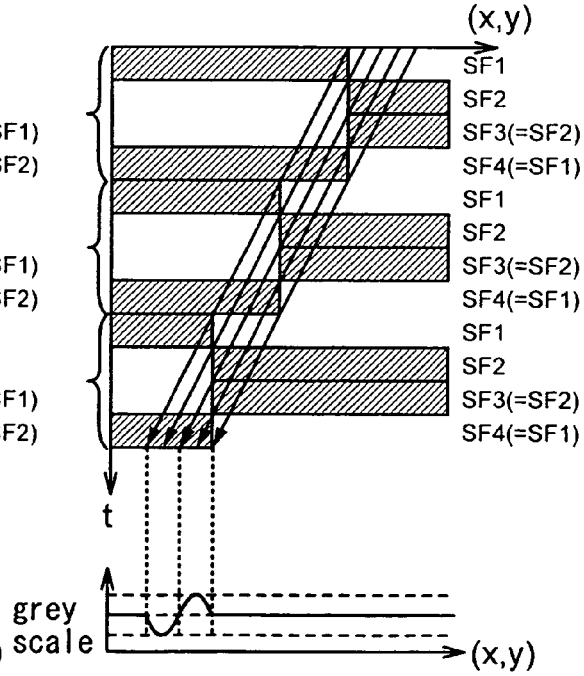

FIGS. 3A and 3C show display using conventional subframe periods and FIGS. 3B and 3D show display using the subframe periods of the invention to compare with each other. FIGS. 3A and 3B show a conventional example and an example of the invention respectively, in which display moves for each frame. A portion with a pattern denotes black display while a portion with no pattern denotes a light emitting state. In addition, the abscissa denotes the row direction or the column direction while the ordinate denotes the time in FIGS. 3A and 3B. One frame period includes four subframe periods (SF1 to SF4), and the respective light emitting states in SF1 and SF3, and those in SF2 and SF4 are identical to each other in FIG. 3A. In the invention, inversion of subframe periods is carried out at the middle point in one frame period to display as shown in FIG. 3B, and therefore, the respective light emitting states in SF1 and SF4, and those in SF2 and SF3 are identical to each other.

When turning eyes on the direction indicated by an arrowhead in FIG. 3A, there are many black display portions, which makes a black contour line that normally does not exist, that is, a moving image pseudo contour visible. On the other hand, when turning eyes on the direction indicated by an arrowhead in FIG. 3B, there are black display portions and white display portions at the same ratio. That is, the black display portions and the white display portions cancel each other in FIG. 3B, so that a moving image pseudo contour can be prevented.

FIGS. 3C and 3D show a conventional example and an example of the invention, of which light emitting timing is reverse to those of FIGS. 3A and 3B respectively.

When turning eyes on the direction indicated by an arrowhead in FIG. 3C, there are many white display portions, which makes a white contour line that normally does not exist, that is, a moving image pseudo contour visible. On the other hand, when turning eyes on the direction indicated by an arrowhead in FIG. 3D, there are white display portions and black display portions at the same ratio. That is, the white display portions and the black display portions cancel each other in FIG. 3D, so that a moving image pseudo contour can be prevented.

Note that it is preferable to increase the frame frequency in order to prevent a pseudo contour. Furthermore, the frame frequency may be 60 Hz or more, preferably 90 Hz or more in this embodiment mode in order to prevent a flicker as well.

In addition, in this embodiment mode, it is preferable that timing is determined so as to provide a subframe period having a longer light emitting period at a point near the middle of the set of subframe periods, that is, at a position as the half period of the frame period. For example, in the case where a set of subframe periods includes SF1 to SF5 providing SF1 has the longest light emitting period and the other subframe periods SF2 to SF5 have the descending light emitting periods in this order respesctively, the subframe periods are preferably provided in the following order: SF4, SF2, SF1, SF3, and SF5, or reversely, SF5, SF3, SF1, SF2, and SF4. This is because by providing a point for inversion of a set of subframe periods (hereinafter referred to as a center of light emission) at a position near the middle of the frame period, namely at a position as the half period of the frame period, a gap between the center of light emission and a center of light emission when the set of subframe periods is inverted can be reduced. Consequently, generation of flicker can be reduced further.

EMBODIMENT MODE 2

In this embodiment mode, timing charts which are different from those in the above embodiment mode are described.

Figure 2A:
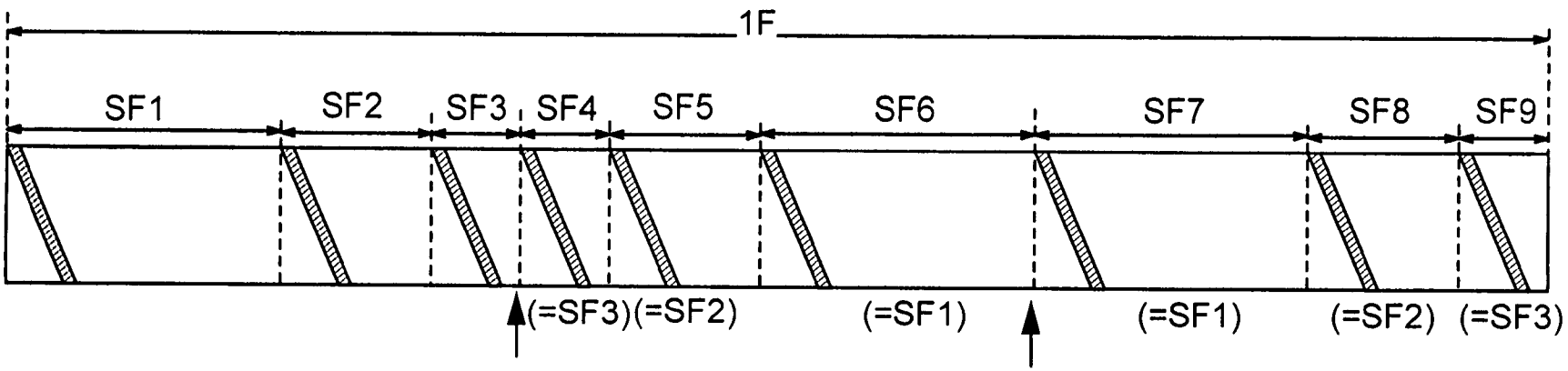
FIGS. 2A and 2B are diagrams each showing a timing chart of the invention.

In FIG. 2A, one frame period is divided into subframe periods SF1 to SF9 in which respective subframe period lengths of SF1 and SF6 and SF7, those of SF2 and SF5 and SF8, and those of SF3 and SF4 and SF9 are equal to each other. That is, a set of subframe periods (SF1 to SF3) is inverted between SF3 and SF4 (a point indicated by an arrowhead) and then inverted between SF6 and SF7 (a point indicated by an arrowhead). In other words, a set of the subframe periods is inverted at an end of the preceding set of the subframe periods (SF1 to SF3).

Figure 2B:
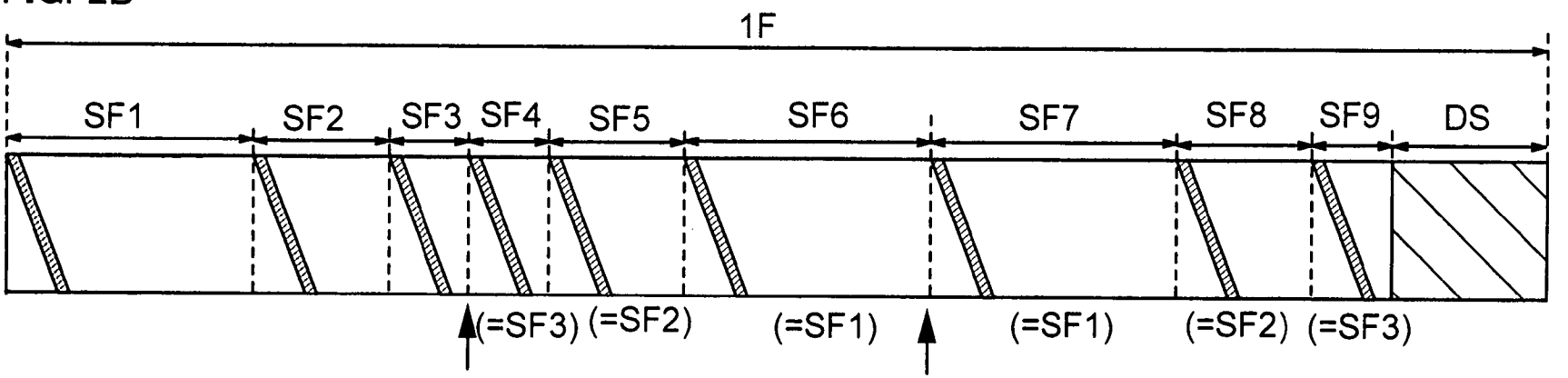

FIG. 2B is a timing chart in which a reverse-voltage applying period (DS) is provided in the timing chart in FIG. 2A. The same structure as that in FIG. 2A other than the reverse-voltage applying period (DS) is omitted to describe. By applying a reverse voltage to the light emitting element in the reverse-voltage applying period as described above, degradation state thereof is improved, leading to improvement of the reliability. The light emitting element may have an initial defect that the anode and the cathode thereof are short-circuited due to adhesion of foreign substances, some pinholes that are produced by minute projections of the anode or the cathode, or irregularity of the electroluminescent layer. Such an initial defect is eliminated by applying the reverse voltage, which leads to favorable image display. Note that the insulation of the short-circuited portion is preferably performed before shipping.

In this embodiment mode, a position at which the reverse-voltage applying period is provided is not limited to that shown in FIG. 2B. For example, it may be provided before or after each one of SF1 to SF6. In addition, in the case of applying a reverse voltage, the reverse-voltage applying period is not necessarily provided for one frame period.

As described above, a set of subframe periods is inverted sequentially at a plurality of positions in one frame period according to this embodiment mode. Consequently, a pseudo contour can be prevented.

The number and length of subframe periods provided in a set of subframe periods are not limited to those shown in FIGS. 2A and 2B in this embodiment mode. In addition, the number of points for inversion is not limited to that shown in FIGS. 2A and 2B.

Note that it is preferable to increase the frame frequency in order to prevent generation of pseudo contour. Therefore, the frame frequency may be 60 Hz or more, preferably 90 Hz or more in this embodiment mode.

In addition, in this embodiment mode, it is preferable that timing is determined so as to provide a subframe period having a longer light emitting period at a position near the middle of the set of subframe periods, that is, at a position as the half period of the frame period. For example, in the case where a set of subframe periods includes SF1 to SF5 providing SF1 has the longest light emitting period and the other subframe periods SF2 to SF5 have the descending light emitting periods in this order respesctively, the subframe periods are preferably provided in the following order: SF4, SF2, SF1, SF3, and SF5, or reversely, SF5, SF3, SF1, SF2, and SF4. This is because by providing a center of light emission of a set of subframe periods at a position near the middle of the frame period, namely at a position as the half period of the frame period, a gap between the center of light emission and a center of light emission when the set of subframe periods is inverted can be reduced. Consequently, generation of flicker can be further reduced.

EMBODIMENT MODE 3

Figure 4A:
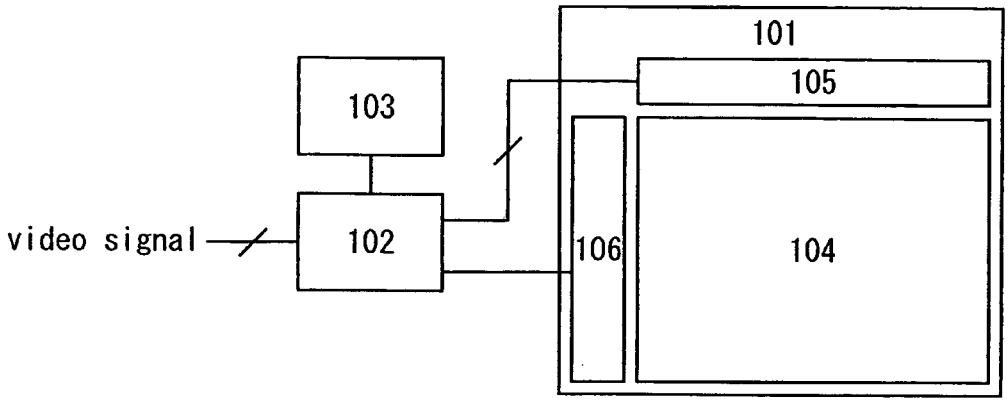
FIGS. 4A and 4B are diagrams showing the light emitting device of the invention.
Figure 4B:
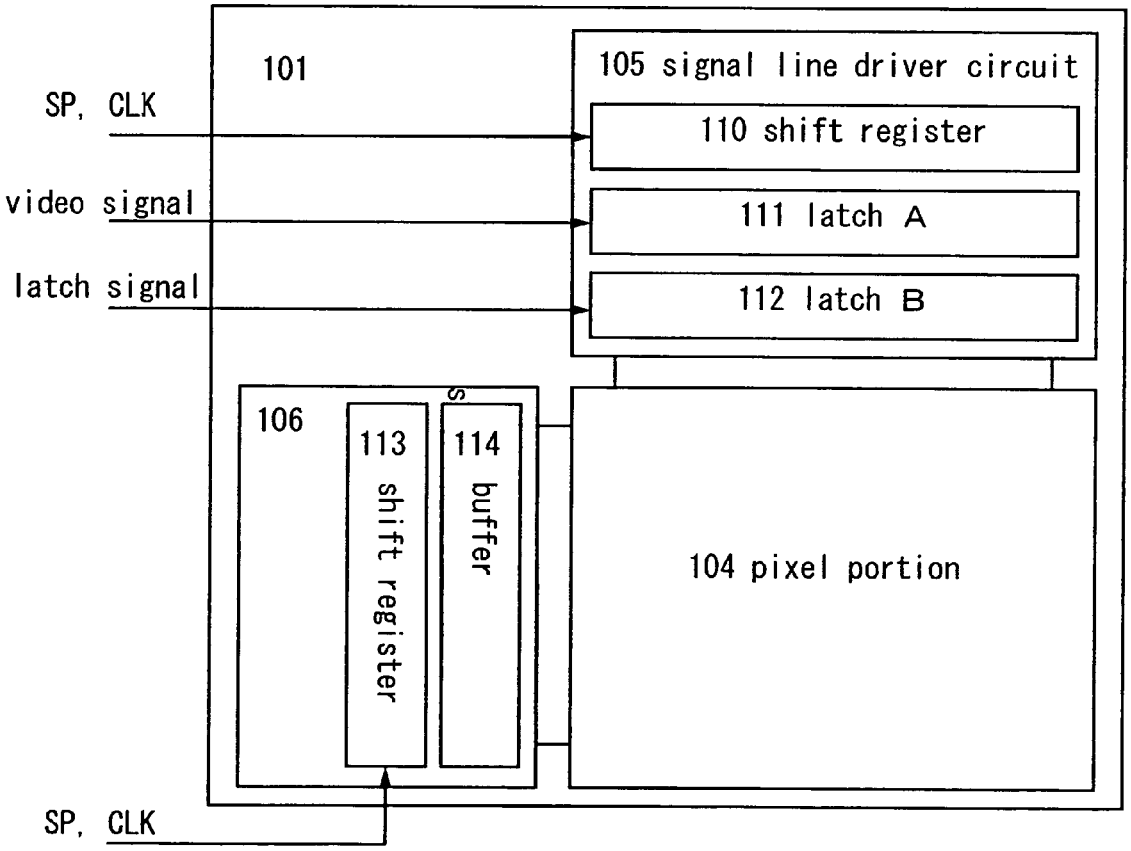

Specific constitution of a light emitting device which is one of display devices is described in this embodiment mode. FIGS. 4A and 4B are block diagrams of exemplary constitution of a light emitting device of the invention. A light emitting device shown in FIG. 4A comprises a panel 101, a controller 102, and a table 103. The panel 101 comprises a pixel portion 104 including a plurality of pixels each having a light emitting element, a signal line driver circuit 105, and a scan line driver circuit 106.

The table 103 is structured by hardware such as a memory which is, for example, a ROM or a RAM, and the plurality of the tables 103 is provided in accordance with the pixels. The memory stores data on a pixel arrangement corresponding to each table. In addition, the memory stores the number and length of a plurality of subframe periods for one frame period, and data for determining a subframe period for light emission in each gray scale level among the plurality of subframe periods in accordance with a subframe ratio $R_{SF}$. The subframe ratio $R_{SF}$ is calculated following a sharing ratio $R_{sh}$ determined depending on the frame frequency.

The controller 102 can determine a subframe period for light emission depending on the gray scale level of an inputted video signal, in accordance with the data stored in the table 103, and output it. In addition, the controller 102 has a frame memory, and can generate various control signals such as a clock signal and a start pulse signal depending on the each length of a plurality of subframe periods stored in the table 103, the operating frequency of the signal line driver circuit 105 and the scan line driver circuit 106, and the like.

Although video signal conversion and control signal generation are performed by the controller 102 in FIG. 4A, the invention is not limited to this constitution. A controller for converting a video signal and a controller for generating a control signal may be provided separately in the light emitting device.

FIG. 4B is an exemplary specific constitution of the panel 101 shown in FIG. 4A.

In FIG. 4B, the signal line driver circuit 105 includes a shift register 110, a latch A 111, and a latch B 112. Control signals such as a clock signal (CLK) and a start pulse signal (SP) are inputted into the shift register 110. When the clock signal (CLK) and the start pulse signal (SP) are inputted, a timing signal is generated in the shift register 110. The generated timing signal is inputted into the first-stage latch A 111 sequentially. When input of the timing signal into the latch A 111 is completed, a video signal being inputted from the controller 102 is sequentially inputted into the latch A 111 in synchronization with a pulse of the inputted timing signal, and held. It is to be noted that although the video signal is inputted into the latch A 111 sequentially in this embodiment mode, the invention is not limited to this structure. Alternatively, so-called division drive, that is, to divide a plurality of stages of the latch A 111 into several groups and input a video signal in parallel per group may be performed. Note that the number of the groups here is called the dividing number. For example, when the latch is divided into four groups of stages, four-division drive is performed.

The period for completing video signal input into all of the latch stages of the latch A 111 is called a row selection period. Practically, there may be a case where a row selection period includes a horizontal retrace period in addition to the aforementioned row selection period.

One row selection period terminates, and then a latch signal that is one of control signals is supplied to the second-stage latch B 112. In synchronization with the latch signal, the video signal held in the latch A 111 is written all at once into the latch B 112. When sending of the video signal to the latch B 112 terminates, the latch A 111 is sequentially inputted with a video signal of the next bit in synchronization with the timing signal from the shift register 110 again. During the second one row selection period, the video signal written and held in the latch B 112 is inputted into the pixel portion 104.

It is to be noted that instead of the shift register 110, a circuit which is capable of selecting a signal line such as a decoder may be used.

Next, constitution of the scan line driver circuit 106 is described. The scan line driver circuit 106 includes a shift register 113 and a buffer 114. In addition, a level shifter may be included if necessary. In the scan line driver circuit 106, a clock signal (CLK) and a start pulse signal (SP) are inputted into the shift register 113 to generate a selection signal. The generated selection signal is amplified in the buffer 114 to be supplied to the corresponding scan line. Since the selection signal supplied to the scan line controls operation of transistors included in pixels for one row, a buffer which is capable of supplying a relatively large amount of current to a scan line is preferably used as the buffer 114.

It is to be noted that instead of the shift register 113, a circuit which is capable of selecting a signal line such as a decoder may be used.

The scan line driver circuit 106 and the signal line driver circuit 105 may be formed over either the same substrate as the pixel portion 104, or a different substrate in this invention. Alternatively, the scan line driver circuit 106 or the signal line driver circuit 105 formed by an IC chip may be mounted. Constitution of the panel in the light emitting device of the invention is not limited to that shown in FIGS. 4A and 4B so long as the panel 101 has such constitution that the pixel gray scale level is controlled in accordance with a video signal inputted from the controller 102.

By employing a plurality of tables in such a light emitting device, generation of pseudo contour can be prevented.

In display devices other than the above, by employing a memory storing a plurality of tables, generation of pseudo contour can be prevented as well.

EMBODIMENT MODE 4

Next, an equivalent circuit diagram of a pixel in the light emitting device of the invention is described with reference to FIGS. 5A to 5C.

Figure 5A:
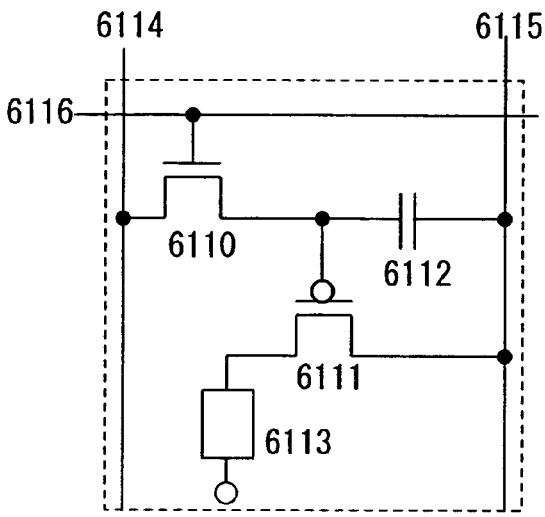
FIGS. 5A to 5C are equivalent circuit diagrams of a pixel of the light emitting device of the invention.

FIG. 5A is an example of an equivalent circuit diagram of a pixel, which includes a signal line 6114, a power supply line 6115, a scan line 6116, a light emitting element 6113, transistors 6110 and 6111, and a capacitor 6112. The signal line 6114 is inputted with a video signal by a signal line driver circuit. The transistor 6110 can control supply of potential of the video signal to a gate of the transistor 6111 in accordance with a selection signal inputted into the scan line 6116. The transistor 6111 can control supply of current to the light emitting element 6113 in accordance with the potential of the video signal. The capacitor 6112 can hold gate-source voltage of the transistor 6111. It is to be noted that although the capacitor 6112 is provided in FIG. 5A, it may not be provided if the gate capacitance of the transistor 6111 or the other parasitic capacitance are enough.

Figure 5B:
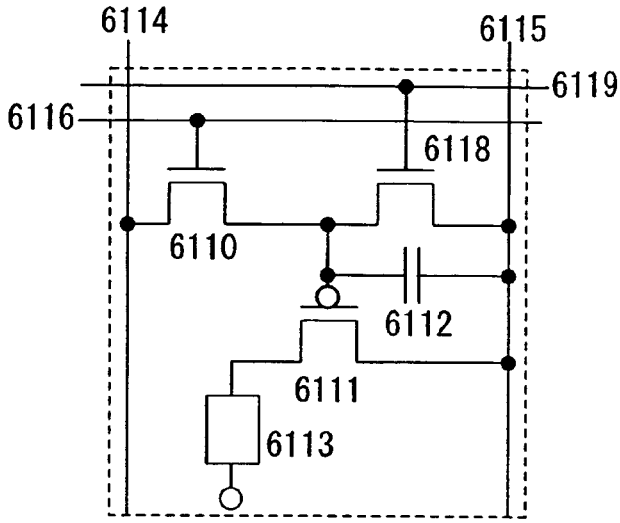

FIG. 5B is an equivalent circuit diagram of a pixel where a transistor 6118 and a scan line 6119 are additionally provided in the pixel shown in FIG. 5A. By the transistor 6118, potential of the gate and the source of the transistor 6111 can be equal to each other to make no current flow into the light emitting element 6113 forcibly. Therefore, the period for each subframe period can be set to be shorter than a period for inputting video signals into all pixels. Accordingly, display can be performed with high total gray scale level while suppressing the operating frequency.

Figure 5C:
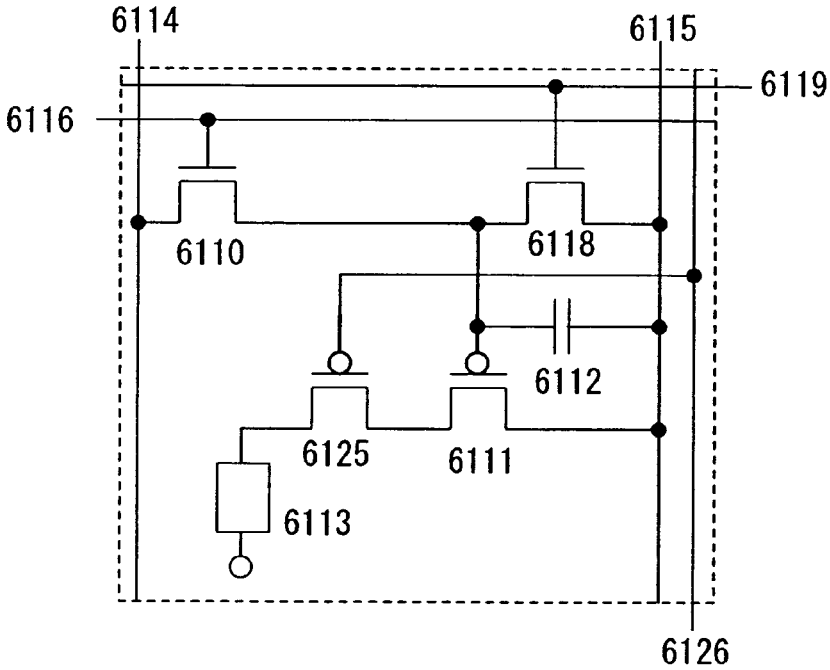

FIG. 5C is an equivalent circuit diagram of a pixel where a transistor 6125 and a wiring 6126 are additionally provided in the pixel shown in FIG. 5B. Gate potential of the transistor 6125 is fixed by the wiring 6126. In addition, the transistors 6111 and 6125 are connected in series between the power source line 6115 and the light emitting element 6113. Therefore, in FIG. 5C, the transistor 6125 controls the amount of current supplied to the light emitting element 6113 while the transistor 6111 controls whether the current is supplied or not to the light emitting element 6113.

It is to be noted that a configuration of a pixel circuit in the light emitting device of the invention is not limited to those described in this embodiment, and the invention can be applied to any display device performing time gray scale display. This embodiment mode can be freely combined with the above-described embodiment modes.

EMBODIMENT MODE 5

In this embodiment mode, a sectional structure of a pixel where a transistor for controlling current supply to a light emitting element is a p-type thin film transistor (TFT) is described with reference to FIGS. 6A to 6C. Note that, in the invention, one of the anode and the cathode of the light emitting element, of which potential can be controlled by a transistor is referred to as a first electrode, and the other is referred to as a second electrode. Although description is made on the case where the first electrode is the anode and the second electrode is the cathode in FIGS. 6A to 6C, it is possible that the first electrode is the cathode and the second electrode is the anode as well.

Figure 6A:
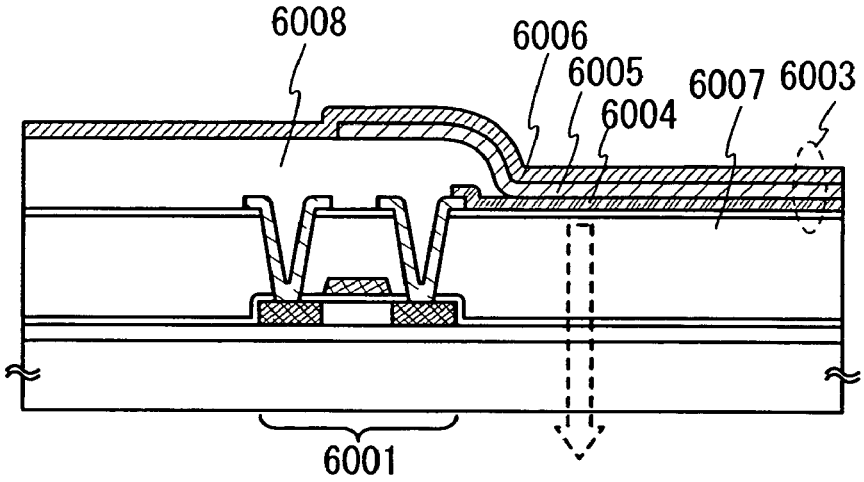
FIGS. 6A to 6C are sectional views of the light emitting device of the invention.

FIG. 6A is a sectional view of a pixel where a TFT 6001 is a P-channel type and a light emitting element 6003 emits light toward a first electrode 6004 side. The first electrode 6004 of the light emitting element 6003 is electrically connected to the TFT 6001 in FIG. 6A.

The TFT 6001 has a patterned semiconductor film, a gate insulating film, a gate electrode, and a source electrode and a drain electrode each connected to an impurity region of the semiconductor film. The TFT 6001 is covered with an interlayer insulating film 6007, and a bank 6008 having an opening is formed over the interlayer insulating film 6007. In the opening of the bank 6008, the first electrode 6004 is partially exposed, and the first electrode 6004, an electroluminescent layer 6005 and a second electrode 6006 are stacked in this order.

The interlayer insulating film 6007 can be formed by an organic resin film, an inorganic insulating film, or an insulating film containing siloxane as a starting material and having Si—O—Si bonds (hereinafter referred to as a "siloxane insulating film"). Siloxane is composed of a skeleton formed by the bond of silicon (Si) and oxygen (O), in which an organic group containing at least hydrogen (such as an alkyl group or aromatic hydrocarbon) is included as a substituent. Alternatively, a fluoro group may be used as the substituent. Further alternatively, a fluoro group and an organic group containing at least hydrogen may be used as the substituent. The interlayer insulating film 6007 may also be formed using a so-called low dielectric constant material (low-k material).

The bank 6008 can be formed by an organic resin film, an inorganic insulating film, or a siloxane insulating film. In the case of an organic resin film, for example, acrylic, polyimide, or polyamide can be used. In the case of an inorganic insulating film, silicon oxide, silicon nitride oxide, or the like can be used. Preferably, the bank 6008 is formed by a photosensitive organic resin film and has an opening on the first electrode 6004 which is formed such that the side face thereof has a slope with a continuous curvature, which can prevent the first electrode 6004 and the second electrode 6006 from being connected to each other.

The first electrode 6004 is formed by a material or with a thickness enough to transmit light, and by a material having a high work function so as to be suitable for being used as an anode. For example, the first electrode 6004 can be formed by a light transmitting conductive oxide such as indium tin oxide (ITO), zinc oxide (ZnO), indium zinc oxide (IZO), and gallium-doped zinc oxide (GZO). Alternatively, the first electrode 6004 may be formed by a mixture of indium tin oxide containing ITO and silicon oxide (hereinafter referred to as ITSO) or indium oxide containing silicon oxide with 2 to 20 atomic % of zinc oxide (ZnO). Further, other than the aforementioned light transmitting conductive oxide, the first electrode 6004 may be formed by using, for example, a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film. However, when employing a material other than the light transmitting conductive oxide, the first electrode 6004 is formed thick enough to transmit light (preferably about 5 to 30 nm).

The second electrode 6006 is formed by a material and with a thickness enough to reflect or shield light, and can be formed by a material having a low work function such as a metal, an alloy, an electrically conductive compound, or a mixture of them. Specifically, an alkali metal such as Li and Cs, an alkaline earth metal such as Mg, Ca and Sr, an alloy containing such metals (Mg:Ag, Al:Li, Mg:In, or the like), a compound of such metals ($CaF_2$ or CaN), or a rare-earth metal such as Yb and Er can be employed. When providing an electron injection layer in the electroluminescent layer so as to contact the second electrode, a conductive layer such as an Al layer can be employed as well.

The electroluminescent layer 6005 is structured by a single layer or a plurality of layers. In the case of a plurality of layers, these layers can be classified into a hole injection layer, a hole transporting layer, a light emitting layer, an electron transporting layer, an electron injection layer and the like in terms of the carrier transporting property. When the electroluminescent layer 6005 has any of the hole injection layer, the hole transporting layer, the electron transporting layer and the electron injection layer in addition to the light emitting layer, the hole injection layer, the hole transporting layer, the light emitting layer, the electron transporting layer and the electron injection layer are stacked in this order on the first electrode 6004. Note that the boundary between the layers is not necessarily distinct, and the boundary may not be distinguished clearly since the materials forming the respective layers are partially mixed. Each of the layers can be formed by an organic material or an inorganic material. As for an organic material, any of the high, medium and low molecular weight materials can be employed. Note that the medium molecular weight material means a low polymer in which the repeated number of structural units (the degree of polymerization) is about 2 to 20. There is no clear distinction between the hole injection layer and the hole transporting layer, and the hole transporting property (hole mobility) is particularly significant in both of them. The hole injection layer is in contact with the anode, and a layer in contact with the hole injection layer is referred to as a hole transporting layer to be distinguished for convenience. The same are applied to the electron transporting layer and the electron injection layer, and the electron transporting property (electron mobility) is particularly significant in both of them. A layer in contact with the cathode is called an electron injection layer while a layer in contact with the electron injection layer is called an electron transporting layer. The light emitting layer may additionally have the function of the electron transporting layer, and thus may be called a light emitting electron transporting layer.

In the pixel shown in FIG. 6A, light emitted from the light emitting element 6003 can be extracted from the first electrode 6004 side as shown by a hollow arrow.

Figure 6B:
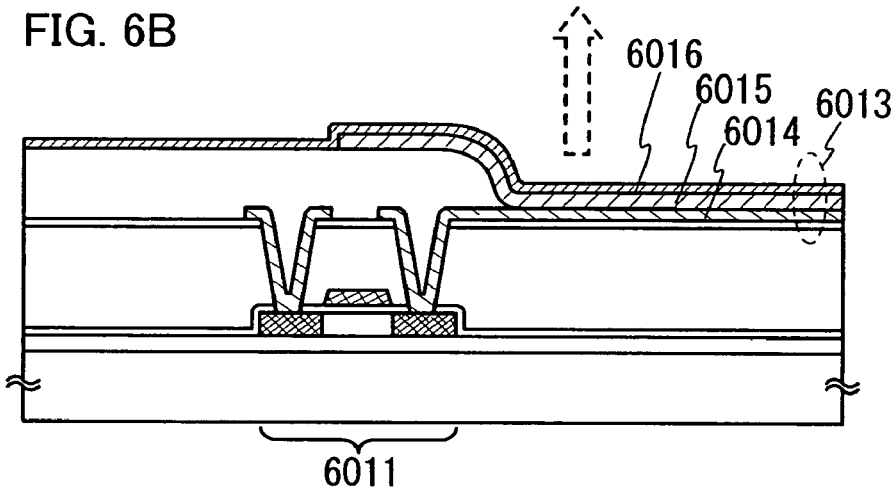

FIG. 6B is a sectional view of a pixel where a TFT 6011 is a P-channel type and light emitted from a light emitting element 6013 is extracted from a second electrode 6016 side. A first electrode 6014 of the light emitting element 6013 is electrically connected to the TFT 6011 in FIG. 6B. On the first electrode 6014, an electroluminescent layer 6015 and the second electrode 6016 are stacked in this order.

The first electrode 6014 is formed by a material and with a thickness enough to reflect or shield light, and formed by a material suitable for being used as an anode. For example, the first electrode 6014 may be formed by a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film.

The second electrode 6016 is formed by a material or with a thickness enough to transmit light, and can be formed by a metal, an alloy, an electrically conductive compound each having a low work function or a mixture of them. Specifically, an alkali metal such as Li and Cs, an alkaline earth metal such as Mg, Ca and Sr, an alloy containing such metals (Mg:Ag, Al:Li, Mg:In, or the like), a compound of such metals ($CaF_2$ or CaN), or a rare-earth metal such as Yb and Er can be employed. When providing an electron injection layer, a conductive layer such as an Al layer can be employed as well. Moreover, the second electrode 6016 is formed thick enough to transmit light (preferably about 5 to 30 nm). Note that the second electrode 6016 may also be formed by a light transmitting conductive oxide such as indium tin oxide (ITO), zinc oxide (ZnO), indium zinc oxide (IZO), and gallium-doped zinc oxide (GZO). Alternatively, a mixture of indium tin oxide containing ITO and silicon oxide (ITSO) or indium oxide containing silicon oxide with 2 to 20 atomic % of zinc oxide (ZnO) may be employed. In the case of employing a light transmitting conductive oxide, an electron injection layer is preferably provided in the electroluminescent layer 6015 so as to contact the second electrode 6016.

The electroluminescent layer 6015 can be formed similarly to the electroluminescent layer 6005 shown in FIG. 6A.

In the pixel shown in FIG. 6B, light emitted from the light emitting element 6013 can be extracted from the second electrode 6016 side as shown by a hollow arrow.

Figure 6C:
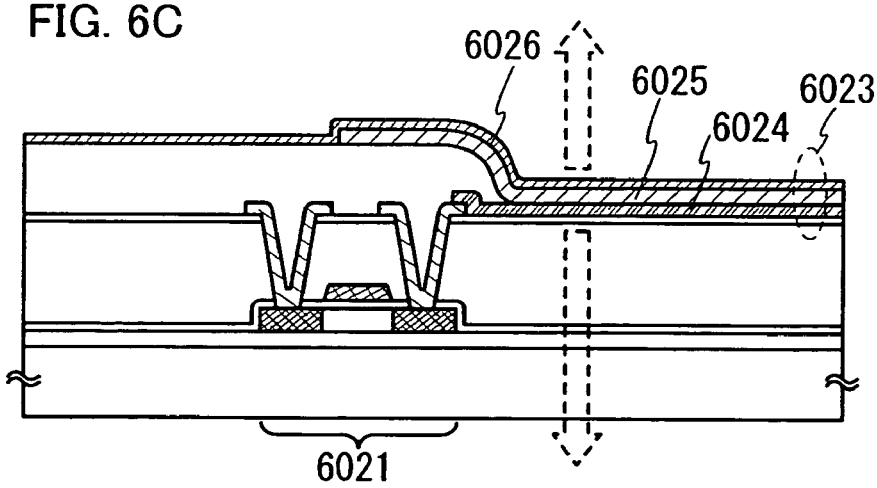

FIG. 6C is a sectional view of a pixel where a TFT 6021 is a P-channel type and light emitted from a light emitting element 6023 is extracted from both a first electrode 6024 side and a second electrode 6026 side. The first electrode 6024 of the light emitting element 6023 is electrically connected to the TFT 6021 in FIG. 6C. On the first electrode 6024, an electroluminescent layer 6025 and the second electrode 6026 are stacked in this order.

The first electrode 6024 can be formed similarly to the first electrode 6004 shown in FIG. 6A while the second electrode 6026 can be formed similarly to the second electrode 6016 shown in FIG. 6B. The electroluminescent layer 6025 can be formed similarly to the electroluminescent layer 6005 shown in FIG. 6A.

In the pixel shown in FIG. 6C, light emitted from the light emitting element 6023 can be extracted from both the first electrode 6024 side and the second electrode 6026 side as shown by hollow arrows.

This embodiment mode can be freely combined with any of the above-described embodiment modes.

EMBODIMENT MODE 6

Figure 7A:
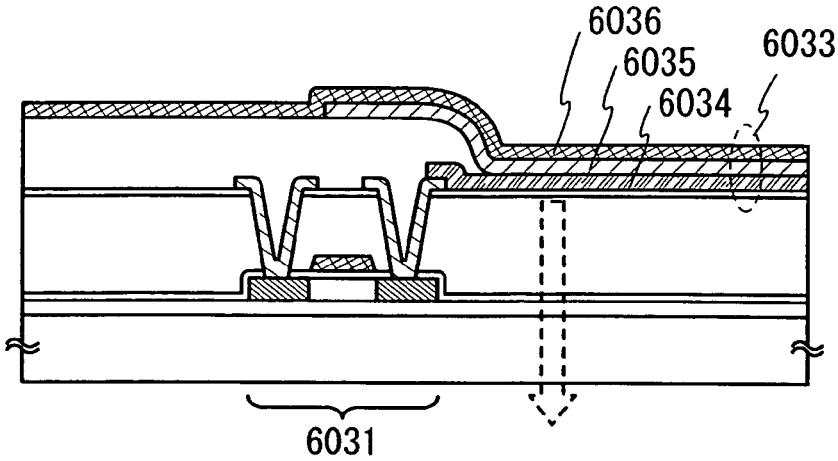
FIGS. 7A to 7C are sectional views of the light emitting device of the invention.
Figure 7B:
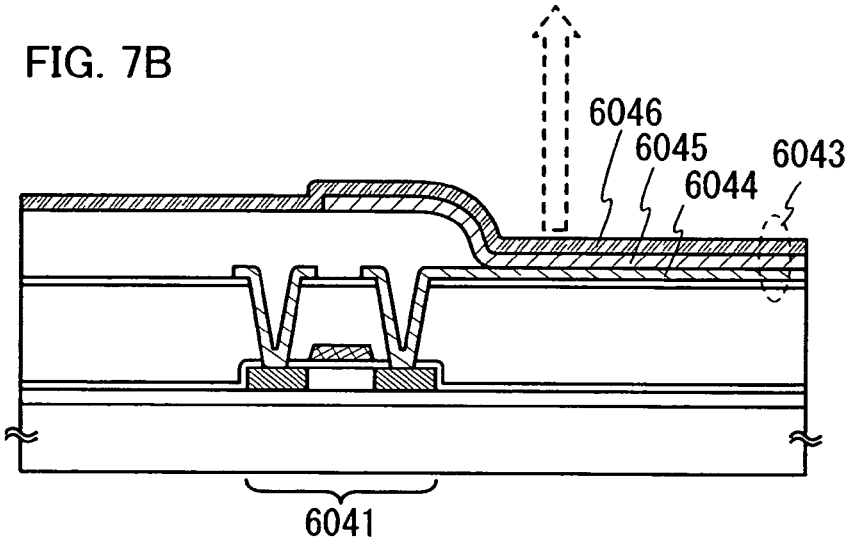
Figure 7C:
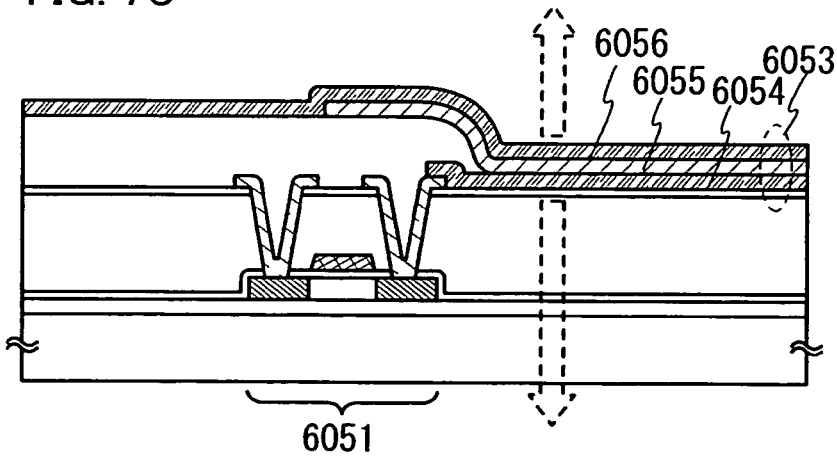

In this embodiment, a sectional structure of a pixel where a transistor for controlling current supply to a light emitting element is an N-channel type is described using FIGS. 7A to 7C. Note that although a first electrode is a cathode while a second electrode is an anode in FIGS. 7A to 7C, it is possible that the first electrode is an anode while the second electrode is a cathode as well.

FIG. 7A is a sectional view of a pixel where a TFT 6031 is an N-channel type and light emitted from a light emitting element 6033 is extracted from a first electrode 6034 side. The first electrode 6034 of the light emitting element 6033 is electrically connected to the TFT 6031 in FIG. 7A. On the first electrode 6034, an electroluminescent layer 6035 and a second electrode 6036 are stacked in this order.

The first electrode 6034 is formed by a material or with a thickness enough to transmit light, and can be formed by a metal, an alloy, an electrically conductive compound each having a low work function, or a mixture of them. Specifically, an alkali metal such as Li and Cs, an alkaline earth metal such as Mg, Ca and Sr, an alloy containing such metals (Mg:Ag, Al:Li, Mg:In, or the like), a compound of such metals ($CaF_2$ or CaN), or a rare-earth metal such as Yb and Er can be employed. When providing an electron injection layer in the electroluminescent layer so as to contact the first electrode, a conductive layer such as an Al layer can be employed as well. Then, the first electrode 6034 is formed thick enough to transmit light (preferably about 5 to 30 nm). Furthermore, a light transmitting conductive layer may be additionally formed using light transmitting conductive oxide so as to contact the top or bottom of the aforementioned conductive layer having a thickness enough to transmit light in order to suppress the sheet resistance of the first electrode 6034. Note that the first electrode 6034 may also be formed by using only a conductive layer employing a light transmitting conductive oxide such as indium tin oxide (ITO), zinc oxide (ZnO), indium zinc oxide (IZO), and gallium-doped zinc oxide (GZO). Alternatively, a mixture of indium tin oxide containing ITO and silicon oxide (ITSO) or indium oxide containing silicon oxide with 2 to 20 atomic % of zinc oxide (ZnO) may be employed. In the case of employing a light transmitting conductive oxide, an electron injection layer is preferably provided in the electroluminescent layer 6035 so as to contact the first electrode 6034.

The second electrode 6036 is formed by a material and with a thickness enough to reflect or shield light, and preferably formed by a material having a high work function so as to be suitable for being used as an anode. For example, the second electrode 6036 may be formed by a single-layer film of one or more of TiN, ZrN, Ti, W, Ni, Pt, Cr, Ag, Al and the like, a laminated layer of a titanium nitride film and a film containing aluminum as a main component, a three-layer structure of a titanium nitride film, a film containing aluminum as a main component and a titanium nitride film, or the like.

The electroluminescent layer 6035 can be formed similarly to the electroluminescent layer 6005 shown in FIG. 6A. When the electroluminescent layer 6035 has any of a hole injection layer, a hole transporting layer, an electron transporting layer and an electron injection layer in addition to a light emitting layer, the electron injection layer, the electron transporting layer, the light emitting layer, the hole transporting layer and the hole injection layer are stacked in this order on the first electrode 6034.

In the pixel shown in FIG. 7A, light emitted from the light emitting element 6033 can be extracted from the first electrode 6034 side as shown by a hollow arrow.

FIG. 7B is a sectional view of a pixel where a TFT 6041 is an N-channel type and light emitted from a light emitting element 6043 is extracted from a second electrode 6046 side. A first electrode 6044 of the light emitting element 6043 is electrically connected to the TFT 6041 in FIG. 7B. On the first electrode 6044, an electroluminescent layer 6045 and the second electrode 6046 are stacked in this order.

The first electrode 6044 is formed by a material and with a thickness enough to reflect or shield light, and can be formed by a metal, an alloy, an electrically conductive compound each having a low work function or a mixture of them. Specifically, an alkali metal such as Li and Cs, an alkaline earth metal such as Mg, Ca and Sr, an alloy containing such metals (Mg:Ag, Al:Li, Mg:In, or the like), a compound of such metals ($CaF_2$ or CaN), a rare-earth metal such as Yb and Er, or the like can be employed. When providing an electron injection layer, a conductive layer such as an Al layer can be employed as well.

The second electrode 6046 is formed by a material or with a thickness enough to transmit light, and by a material suitable for being used as an anode. For example, the second electrode 6046 can be formed by a light transmitting conductive oxide such as indium tin oxide (ITO), zinc oxide (ZnO), indium zinc oxide (IZO), and gallium-doped zinc oxide (GZO). Alternatively, the second electrode 6046 may be formed by a mixture of indium tin oxide containing ITO and silicon oxide (ITSO) or indium oxide containing silicon oxide with 2 to 20 atomic % of zinc oxide (ZnO). Further, other than the aforementioned light transmitting conductive oxide, the second electrode 6046 may be formed by using, for example, a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film. However, when employing a material other than the light transmitting conductive oxide, the second electrode 6046 is formed thick enough to transmit light (preferably about 5 to 30 nm).

The electroluminescent layer 6045 can be formed similarly to the electroluminescent layer 6035 shown in FIG. 7A.

In the pixel shown in FIG. 7B, light emitted from the light emitting element 6043 can be extracted from the second electrode 6046 side as shown by a hollow arrow.

FIG. 7C is a sectional view of a pixel where a TFT 6051 is an N-channel type and light emitted from a light emitting element 6053 is extracted from both a first electrode 6054 side and a second electrode 6056 side. The first electrode 6054 of the light emitting element 6053 is electrically connected to the TFT 6051 in FIG. 7C. On the first electrode 6054, an electroluminescent layer 6055 and the second electrode 6056 are stacked in this order.

The first electrode 6054 can be formed similarly to the first electrode 6034 shown in FIG. 7A while the second electrode 6056 can be formed similarly to the second electrode 6046 shown in FIG. 7B. The electroluminescent layer 6055 can be formed similarly to the electroluminescent layer 6035 shown in FIG. 7A.

In the pixel shown in FIG. 7C, light emitted from the light emitting element 6053 can be extracted from both the first electrode 6054 side and the second electrode 6056 side as shown by hollow arrows.

This embodiment mode can be freely combined with any of the above-described embodiment modes.

EMBODIMENT MODE 7

In this embodiment mode, description is made on the case where the light emitting device is manufactured by a printing method typified by screen printing and offset printing, or a droplet ejecting method. The droplet ejecting method is a method for forming a predetermined pattern by ejecting droplets containing a predetermined composition from a minute hole, which includes an ink-jet method. When using such a printing method or a droplet ejecting method, various wirings typified by a signal line, a scan line, and a selection line, a gate of a TFT, an electrode of a light emitting element, and the like can be formed without using an exposure mask. However, the printing method or the droplet ejecting method is not necessarily used for all steps of forming patterns. Therefore, such a process is possible that wirings and a gate are formed by a printing method or a droplet ejecting method while a semiconductor film is patterned by a lithography method, in which the printing method or the droplet electing method is used for at least a part of the process, and a lithography method is additionally used. Note that a mask for patterning may be formed by a printing method or a droplet ejecting method.

Figure 8:
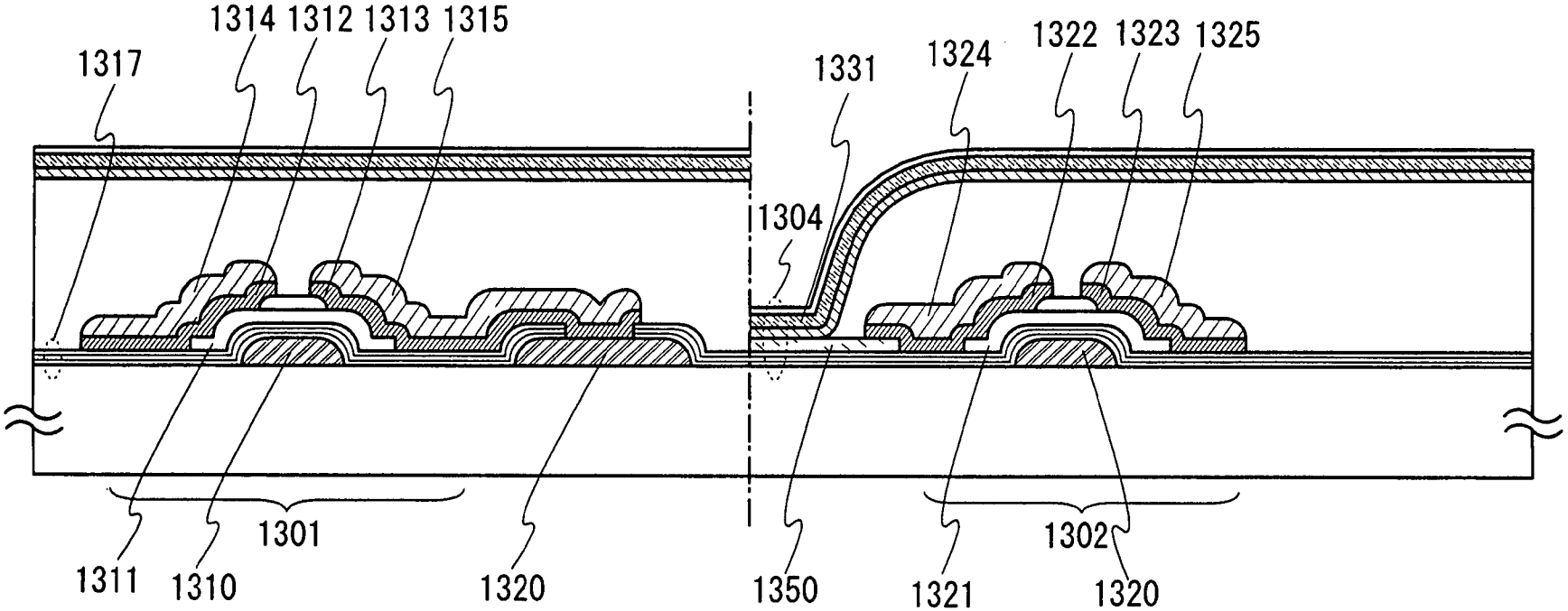
FIG. 8 is a sectional view of the light emitting device of the invention.

FIG. 8 is an exemplary sectional view of a light emitting device of the invention formed using a droplet ejecting method. In FIG. 8, the light emitting device includes a TFT 1301, a TFT 1302, and a light emitting element 1304. The TFT 1302 is electrically connected to a first electrode 1350 of the light emitting element 1304. The TFT 1302 is preferably an N-channel type, and in that case, it is preferable that the first electrode 1350 is a cathode while a second electrode 1331 is an anode.

The TFT 1301 functioning as a switching element has a gate electrode 1310, a first semiconductor film 1311 including a channel formation region, a gate insulating film 1317 formed between the gate electrode 1310 and the first semiconductor film 1311, second semiconductor films 1312 and 1313 functioning as a source or a drain, a wiring 1314 connected to the second semiconductor film 1312, and a wiring 1315 connected to the second semiconductor film 1313.

The TFT 1302 has a gate electrode 1320, a first semiconductor film 1321 including a channel formation region, the gate insulating film 1317 formed between the gate electrode 1320 and the first semiconductor film 1321, second semiconductor films 1322 and 1323 functioning as a source or a drain, a wiring 1324 connected to the second semiconductor film 1322, and a wiring 1325 connected to the second semiconductor film 1323.

The wiring 1314 corresponds to a signal line, and the wiring 1315 is electrically connected to the gate electrode 1320 of the TFT 1302. The wiring 1325 corresponds to a power supply line.

By forming patterns using a droplet ejecting method or a printing method, a series of steps for a lithography method that includes photoresist formation, exposure, development, etching, and peeling can be simplified. In addition, the droplet ejecting method or the printing method can avoid waste of materials that would be removed by etching unlike the case of a lithography method. Further, since an expensive mask for exposure is not required, manufacturing cost of the light emitting device can be suppressed.

In addition, unlike a lithography method, etching is not required in order to form wirings. Accordingly, a step of forming wirings can be completed in an extremely shorter time than the case of the lithography method. In particular, when the wiring is formed with a thickness of 0.5 μm or more, preferably 2 μm or more, the wiring resistance can be suppressed, and therefore, the increase of the wiring resistance along with enlargement of the light emitting device can be suppressed while saving time required for the step of forming wirings.

Note that the first semiconductor films 1311 and 1321 may be either an amorphous semiconductor or a semi-amorphous semiconductor (hereinafter referred to as an SAS).

An amorphous semiconductor can be obtained by decomposing a silicon-source gas by glow discharge. As the typical silicon-source gas, $SiH_4$ or $Si_2H_6$ can be employed. The silicon-source gas may be diluted with hydrogen, or hydrogen and helium.

Similarly, an SAS can be obtained by decomposing a silicon-source gas by glow discharge. As the typical silicon-source gas, $SiH_4$ can be used as well as $Si_2H_6$, $SiH_2Cl_2$, $SiHCl_3$, $SiCl_4$, $SiF_4$, or the like. The SAS can be formed easily by diluting the silicon-source gas with a hydrogen gas or a mixed gas of hydrogen and one or more of rare-gas elements selected among helium, argon, krypton and neon. The silicon-source gas is preferably diluted at a rate of 1:2 to 1:1000. Further, the silicon-source gas may be mixed with a carbon-source gas such as $CH_4$ and $C_2H_6$, a germanium-source gas such as $GeH_4$ and $GeF_4$, or $F_2$ so that the energy bandwidth is controlled to be 1.5 to 2.4 eV, or 0.9 to 1.1 eV. A TFT using an SAS as the first semiconductor film can exhibit the mobility of 1 to 10 $cm^2$/Vsec or more.

The first semiconductor films 1311 and 1321 may also be formed by a semiconductor obtained by crystallizing an amorphous semiconductor or an SAS. For example, the amorphous semiconductor or the SAS can be crystallized by using laser or a heating furnace.

This embodiment mode can be freely combined with any of the above-described embodiment modes.

EMBODIMENT MODE 8

Figure 9A:
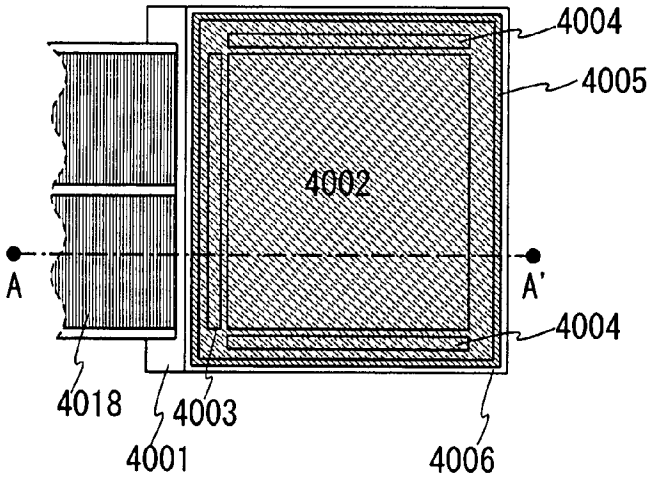
FIGS. 9A and 9B are top plan view and a sectional view of the light emitting device of the invention.
Figure 9B:
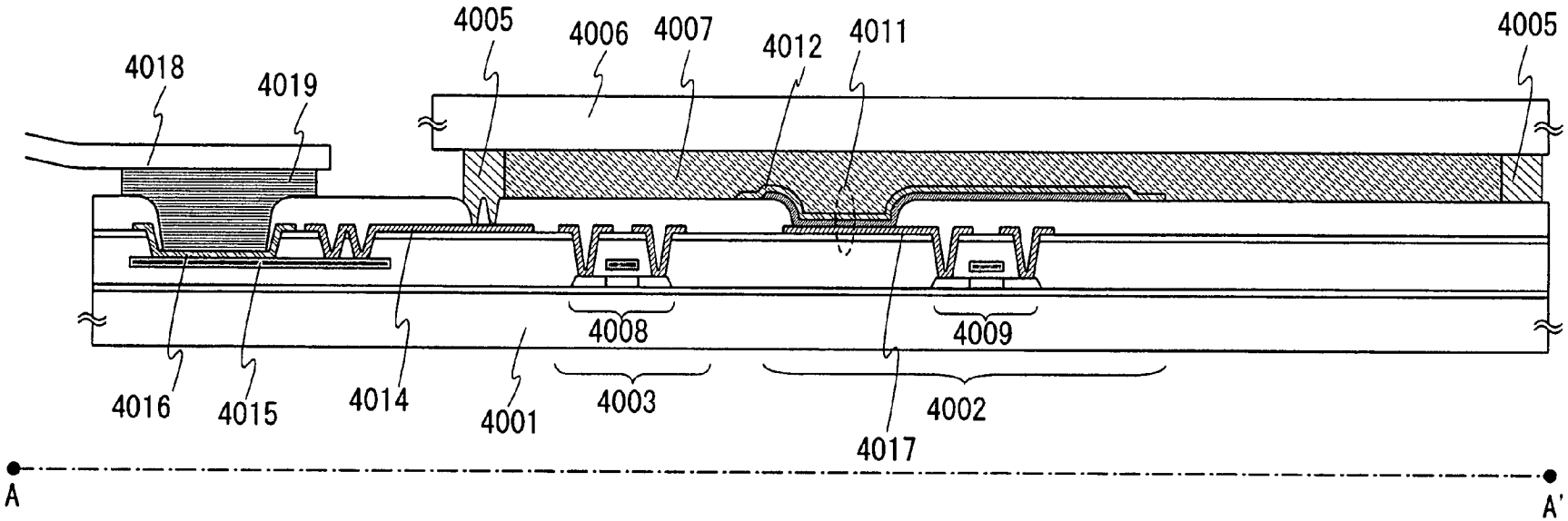

In this embodiment mode, description is made on an exterior view of a panel which corresponds to one mode of the light emitting device of the invention with reference to FIGS. 9A and 9B. FIG. 9A is a top plan view of a panel where TFTs and light emitting elements formed over a first substrate are sealed with a sealant between the first substrate and a second substrate. FIG. 9B is a sectional view of FIG. 9A taken along a line A-A'.

A pixel portion 4002, a signal line driver circuit 4003 and a scan line driver circuit 4004 are provided over a first substrate 4001, and a sealant 4005 is provided so as to surround at least the pixel portion 4002. In addition, a second substrate 4006 is provided over at least the pixel portion 4002 via the sealant 4005. The pixel portion 4002, the signal line driver circuit 4003, and the scan line driver circuit 4004 are tightly sealed by the first substrate 4001, the sealant 4005 and the second substrate 4006 together with a filler 4007 in the light emitting device shown in FIGS. 9A and 9B. As the filler 4007, an inert gas such as nitrogen and argon can be employed.

Each of the pixel portion 4002, the signal line driver circuit 4003, and the scan line driver circuit 4004 formed over the first substrate 4001 includes a plurality of TFTs. In FIG. 9B, a TFT 4008 included in the signal line driver circuit 4003, and a TFT 4009 included in the pixel portion 4002 are illustrated.

Reference numeral 4011 denotes a light emitting element, and a wiring 4017 connected to a drain of the TFT 4009 functions partially as a first electrode of the light emitting element 4011. A transparent conductive film 4012 functions as a second electrode of the light emitting element 4011. Note that the light emitting element 4011 is not limited to the structure described in this embodiment mode, and the structure of the light emitting element 4011 can be appropriately changed in accordance with the extraction direction of light emitted from the light emitting element 4011, the conductivity of the TFT 4009, and the like.

Various signals and voltage supplied to the signal line driver circuit 4003, the scan line driver circuit 4004 and the pixel portion 4002 are supplied from a connecting terminal 4016 via lead wirings 4014 and 4015 although not shown in the sectional view in FIG. 9B.

In this embodiment mode, the connecting terminal 4016 is formed using the same conductive film as the first electrode of the light emitting element 4011. The lead wiring 4014 is formed using the same conductive film as that of the wiring 4017. The lead wiring 4015 is formed using the same conductive film as that of respective gate electrodes of the TFTs 4009 and 4008.

The connecting terminal 4016 is electrically connected to a terminal of an FPC 4018 via an anisotropic conductive film 4019.

It is to be noted that the first substrate 4001 and the second substrate 4006 may be each formed by glass, metal (typically, stainless), ceramics, or plastics. As for the plastic, an FRP (Fiberglass-Reinforced Plastics) plate, a PVF (Polyvinylfluoride) film, a mylar film, a polyester film or an acrylic resin film can be employed. In addition, a sheet having a structure that aluminum is sandwiched by PVF films or mylar films can be employed as well.

Note that the second substrate 4006 is required to transmit light since it is disposed on the side from which light emitted from the light emitting element 4011 is extracted. In that case, a light transmitting material is employed such as a glass plate, a plastic plate, a polyester film and an acrylic film.

As for the filler 4007, besides an inert gas such as nitrogen and argon, an ultraviolet curable resin or a heat curable resin can be used, and for example, PVC (polyvinyl chloride), acrylic, polyimide, an epoxy resin, a silicone resin, PVB (polyvinyl butyral) or EVA (ethylene vinyl acetate) can be used. In this embodiment mode, nitrogen is employed as the filler.

This embodiment mode can be freely combined with the above-described embodiment modes.

EMBODIMENT MODE 9

The display device of the invention can suppress generation of pseudo contour, which is suitable for display portions of portable electronic apparatuses such as a portable phone, a portable game machine or electronic book, a video camera, and a digital still camera. In addition, since the display device of the invention can prevent a pseudo contour, the invention is suitable for electronic apparatuses having a display portion, such as a display device by which moving images can be played and images can be enjoyed.

Further, the display device of the invention can be applied to electronic apparatuses such as a video camera, a digital camera, a goggle type display (a head mounted display), a navigation system, a sound reproducing device (car. audio system, audio component system and the like), a notebook personal computer, a game machine, an image reproducing device equipped with a recording medium (typically, a device reproducing a recording medium such as a DVD (Digital Versatile Disk) and having a display for displaying the reproduced image). Specific examples of such electronic apparatuses are illustrated in FIGS. 10A to 10C.

Figure 10A:
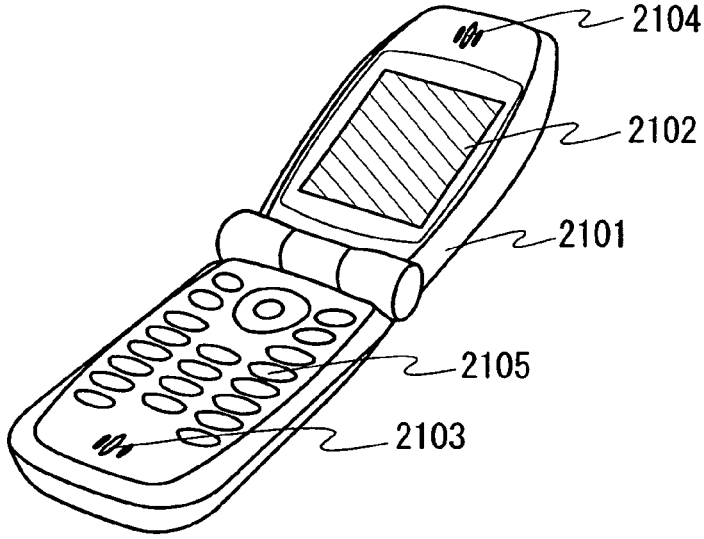
FIGS. 10A to 10C are views of electronic apparatuses of the invention.

FIG. 10A illustrates a portable phone which includes a main body 2101, a display portion 2102, an audio input portion 2103, an audio output portion 2104, and an operating key 2105. A portable phone that is one of the electronic apparatuses of the invention can be completed by forming the display portion 2102 using the display device of the invention.

Figure 10B:
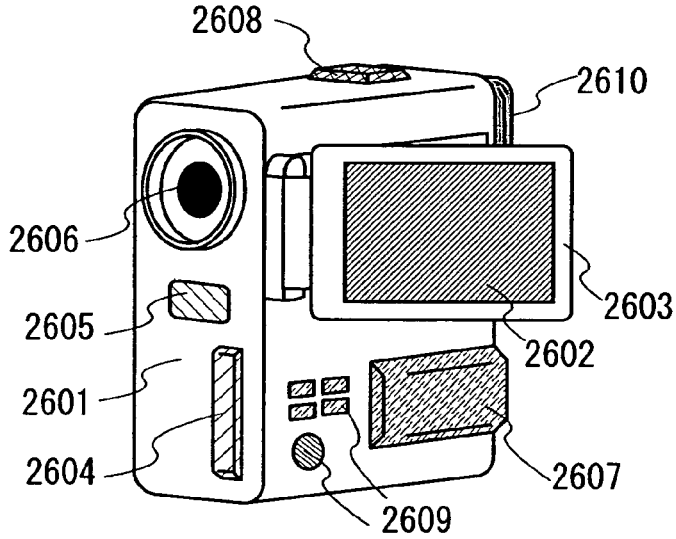

FIG. 10B illustrates a video camera which includes a main body 2601, a display portion 2602, a housing 2603, an external connection port 2604, a remote control receiving portion 2605, an image receiving portion 2606, a battery 2607, an audio input portion 2608, operating keys 2609, and an eye piece portion 2610. A video camera that is one of the electronic apparatuses of the invention can be completed by forming the display portion 2602 using the display device of the invention.

Figure 10C:
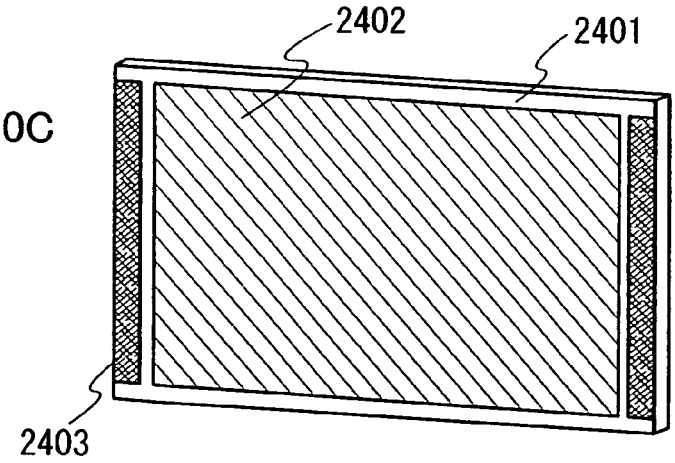

FIG. 10C illustrates a display device which includes a housing 2401, a display portion 2402, and a speaker portion 2403. A display device that is one of the electronic apparatuses of the invention can be completed by forming the display portion 2402 using the display device of the invention. Note that the display device includes any display device for displaying information such as for a personal computer, for receiving TV broadcast, and for displaying advertisement.

As set forth above, the application range of the invention is so wide that it can be applied to electronic apparatuses in various fields. This embodiment mode can be freely combined with the above-described embodiment modes.

EMBODIMENT 1

Described in this embodiment is a specific example of the timing chart described in Embodiment Mode 1 in the case where the frame frequency is 60 Hz and the number of subframes is 32.

Since the frame frequency is 60 Hz, 60 frames appear per second and the length of one frame period here is about 16.67 ms. Subframe periods SF1 to SF16 and inverted periods thereof, namely 16×2=32 subframe periods are provided in one frame period, in which the subframe periods SF1 to SF16 are arranged such that a center of light emission is near the middle of the subframe periods SF1 to SF16. The subframe periods SF1 to SF16 appear in the following order in this embodiment: SF2, SF4, SF6, SF8, SF10, SF12, SF14, SF16, SF15, SF13, SF11, SF9, SF7, SF5, SF3, and SF1. In addition, a set of the subframe periods SF1 to SF16 is inverted respectively at an end of SF1 in one frame period.

The length ratio of the subframe periods SF1 to SF16 is set to be SF1:SF2:SF3:SF4:SF5:SF6:SF7:SF8:SF9:SF10:SF11:SF12:SF13:SF14:SF15:SF16=1:2:4:8:10:10:10:12:12:14:17:21:25:30:36:43.

According to this embodiment also, as shown in FIGS. 11A to 11E, a plurality of subframe periods having the same length is provided. This is because the length of each of the subframe periods is determined considering a sharing ratio. The sharing ratio means the rate of the length of a subframe period for light emission in common in two frame periods of which gray scale levels are different by one.

Specifically, determination of the number and length of subframe periods by considering the sharing ratio is carried out as described below. First, with the obtained sharing ratio $R_{sh}$, the length of each subframe period is determined. n subframe periods for one frame period are referred to as $SF_1$ to $SF_n$ in ascending order of length, and it is here assumed that when light emission is performed in all of $SF_1$ to $SF_p$ (p<n), m gray scales ($m<2^n$) can be displayed. In that case, when $T_m$ denotes the total length of the subframe periods $SF_1$ to $SF_p$ for light emission in displaying m gray scales, $T_m$ can be obtained by the following Formula 1.

$$T_m = \sum_{n=1}^{p} SF_n \quad \text{[Formula 1]}$$

Next, the case of displaying (m+1) gray scales is considered. Since m gray scales can be displayed by emitting light in all of $SF_1$ to $SF_p$, it is necessary to employ $SF_{p+1}$ which is longer than $SF_p$ in order to display (m+1) gray scales. At the same time, it is necessary to subtract one or a plurality of subframe periods, corresponding to the length obtained by subtracting the length for one gray scale (e.g., the length corresponding to $SF_1$) from $SF_{p+1}$, from the subframe periods $SF_1$ to $SF_p$ to display. Consequently, when $T_{m+1}$ denotes the total length of subframe periods for light emission in displaying (m+1) gray scales, $T_{m+1}$ can be obtained by the following Formula 2.

$$T_{m+1} = \sum_{n=1}^{p+1} SF_n - (SF_{p+1} - SF_1) \quad \text{[Formula 2]}$$

When the subframe ratio $R_{SF}$ means the rate of $SF_{p+1}$ in a value obtained by $$\sum_{n=1}^{p+1} SF_n,$$

$R_{SF}$ can be obtained by the following Formula 3.

$$R_{SF} = \frac{SF_{p+1}}{\sum_{n=1}^{p+1} SF_n} \quad \text{[Formula 3]}$$

The following Formula 4 can be derived from Formula 3.

$$SF_{p+1} = \sum_{n=1}^{p+1} SF_n \times R_{SF} \quad \text{[Formula 4]}$$

Then, when $W_{m/m+1}$ denotes the total length of subframe periods for light emission in common in displaying m gray scales and in displaying (m+1) gray scales, $W_{m/m+1}$ can be obtained by the following Formula 5.

$$W_{m/m+1} = T_m - (SF_{p+1} - SF_1) \quad \text{[Formula 5]}$$

Accordingly, the following Formula 6 is derived from Formula 1, Formula 4, and Formula 5.

$$\begin{aligned} W_{m/m+1} &= \sum_{n=1}^{p} SF_n - (SF_{p+1} - SF_1) \\ &= \sum_{n=1}^{p+1} SF_n - SF_{p+1} - (SF_{p+1} - SF_1) \\ &= \sum_{n=1}^{p+1} SF_n - 2 \times R_{SF} \times \sum_{n=1}^{p+1} SF_n + SF_1 \end{aligned} \quad \text{[Formula 6]}$$

In addition, the sharing ratio $R_{sh}$ of subframe periods for light emission in common in displaying m gray scales and in displaying (m+1) gray scales is obtained by the following Formula 7.

$$R_{sh} = W_{m/m+1} / T_{m+1} \quad \text{[Formula 7]}$$

Accordingly, the following Formula 8 is derived from Formula 2, Formula 4, Formula 6, and Formula 7.

$$\begin{aligned} R_{sh} &= \left\{ \sum_{n=1}^{p+1} SF_n - 2 \times R_{SF} \times \sum_{n=1}^{p+1} SF_n + SF_1 \right\} \Big/ \left\{ \sum_{n=1}^{p+1} SF_n - R_{SF} \times \sum_{n=1}^{p+1} SF_n + SF_1 \right\} \\ &\approx \left\{ \sum_{n=1}^{p+1} SF_n - 2 \times R_{SF} \times \sum_{n=1}^{p+1} SF_n \right\} \Big/ \left\{ \sum_{n=1}^{p+1} SF_n - R_{SF} \times \sum_{n=1}^{p+1} SF_n \right\} \\ &= (1 - 2R_{SF}) / (1 - R_{SF}) \end{aligned} \quad \text{[Formula 8]}$$

Accordingly, the following Formula 9 can be derived from Formula 8.

$$R_{SF} = (1 - R_{sh}) / (2 - R_{sh}) \quad \text{[Formula 9]}$$

Consequently, a value of the subframe ratio $R_{SF}$ can be obtained by substituting a value of the sharing ratio $R_{sh}$ into Formula 9. The subframe ratio $R_{SF}$ is the rate of $SF_{p+1}$ in a value obtained by $$\sum_{n=1}^{p+1} SF_n.$$

By using the aforementioned subframe ratio $R_{SF}$, the length of each of the subframe periods can be determined sequentially from that of the longest subframe period $SF_n$. That is, the number and length of a plurality of subframe periods can be determined in accordance with the subframe ratio $R_{SF}$ obtained from the sharing ratio $R_{sh}$.

Figures 11A, 11B, 11C, 11D, 11E:
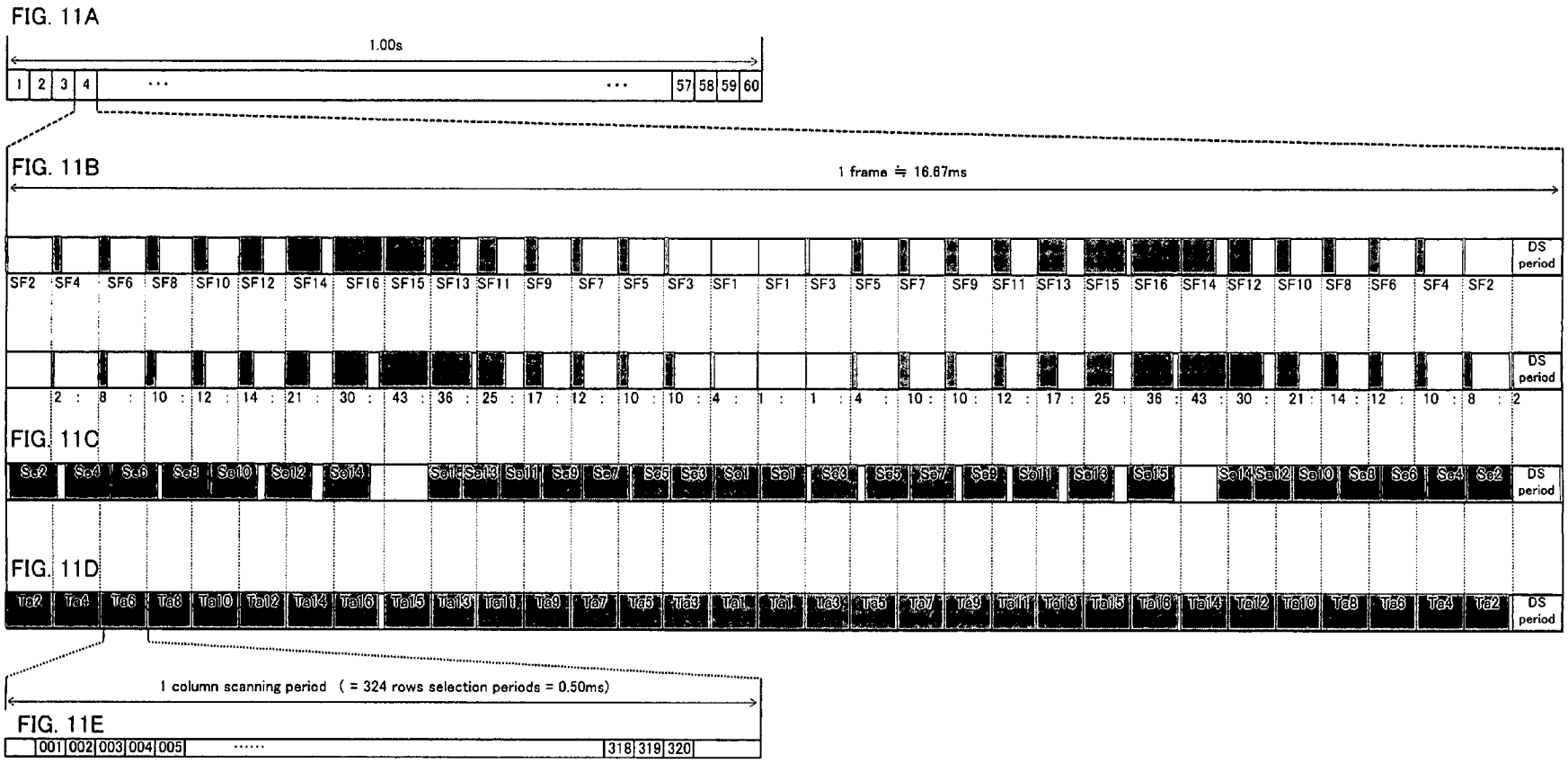
FIGS. 11A to 11E are diagrams showing a specific timing chart of the invention.

In accordance with such subframe periods, display is performed sequentially from pixels of the first row to pixels of the last row as shown in FIG. 11B. FIG. 11B shows the length ratio of the subframe periods.

FIG. 11C shows timing of scanning by a scan line driver circuit for erasing. In this embodiment, erasing periods Se1 to Se15 are provided in the subframe periods SF1 to SF15 and inverted subframe periods thereof SF1 to SF15 respectively.

FIG. 11D shows timing of scanning by a scan line driver circuit for writing. Writing periods Ta1 to Ta16 and inverted writing periods thereof Ta1 to Ta16 are provided in the subframe periods respectively.

One writing period is provided with one column scanning period as shown in FIG. 11E, in which all rows (324 rows in this embodiment) are selected.

It is to be noted that one frame period includes a reverse-voltage applying period (DS). By applying a reverse voltage to a light emitting element, the degradation state of the light emitting element is improved and the reliability thereof can be enhanced.

EMBODIMENT 2

Described in this embodiment is a specific example of the timing chart where a plurality of positions are provided in one frame period as described in Embodiment Mode 2 in the case where the frame frequency is 60 Hz and the number of subframes is 48.

Since the frame frequency is 60 Hz, 60 frames appear per second and the length of one frame period here is about 16.67 ms. Subframe periods SF1 to SF16 and twice-inverted periods thereof, namely 16×3=48 subframe periods are provided in one frame period, in which the subframe periods SF1 to SF16 are arranged in random order. In this embodiment, the subframe periods SF1 to SF16 appear in the following order: SF2, SF4, SF6, SF8, SF10, SF12, SF14, SF16, SF15, SF13, SF11, SF9, SF7, SF5, SF3, and SF1. In addition, a set of the subframe periods SF1 to SF16 are inverted at timing of ⅓ and ⅔ of one frame period. FIGS. 12A to 12F show timing chart A and FIGS. 13A to 13F show timing chart B. The timing chart shown in FIGS. 12A to 12F and the timing chart shown in FIGS. 13A to 13F appear alternately in this embodiment. In addition, the timing chart shown in FIGS. 12A to 12F and the timing chart shown in FIGS. 13A to 13F are inverted with each other.

The length ratio of the subframe periods SF1 to SF16 is set to be SF1:SF2:SF3:SF4:SF5:SF6:SF7:SF8:SF9:SF10:SF11:SF12:SF13:SF14:SF15:SF16=1:2:4:8:10:10:10:12:12:14:17:21:25:30:36:43.

According to this embodiment also, as shown in FIGS. 12A to 12F and 13A to 13F, a plurality of subframe periods having the same length is provided. This is because the length of each of the subframe periods is determined considering the sharing ratio. The sharing ratio means the rate of the length of a subframe period for light emission in common in two frame periods of which gray scale levels are different by one. The number and length of subframe periods are specifically determined by considering the sharing ratio as described in Embodiment 1.

Figures 12A, 12B, 12C, 12D, 12E, 12F:
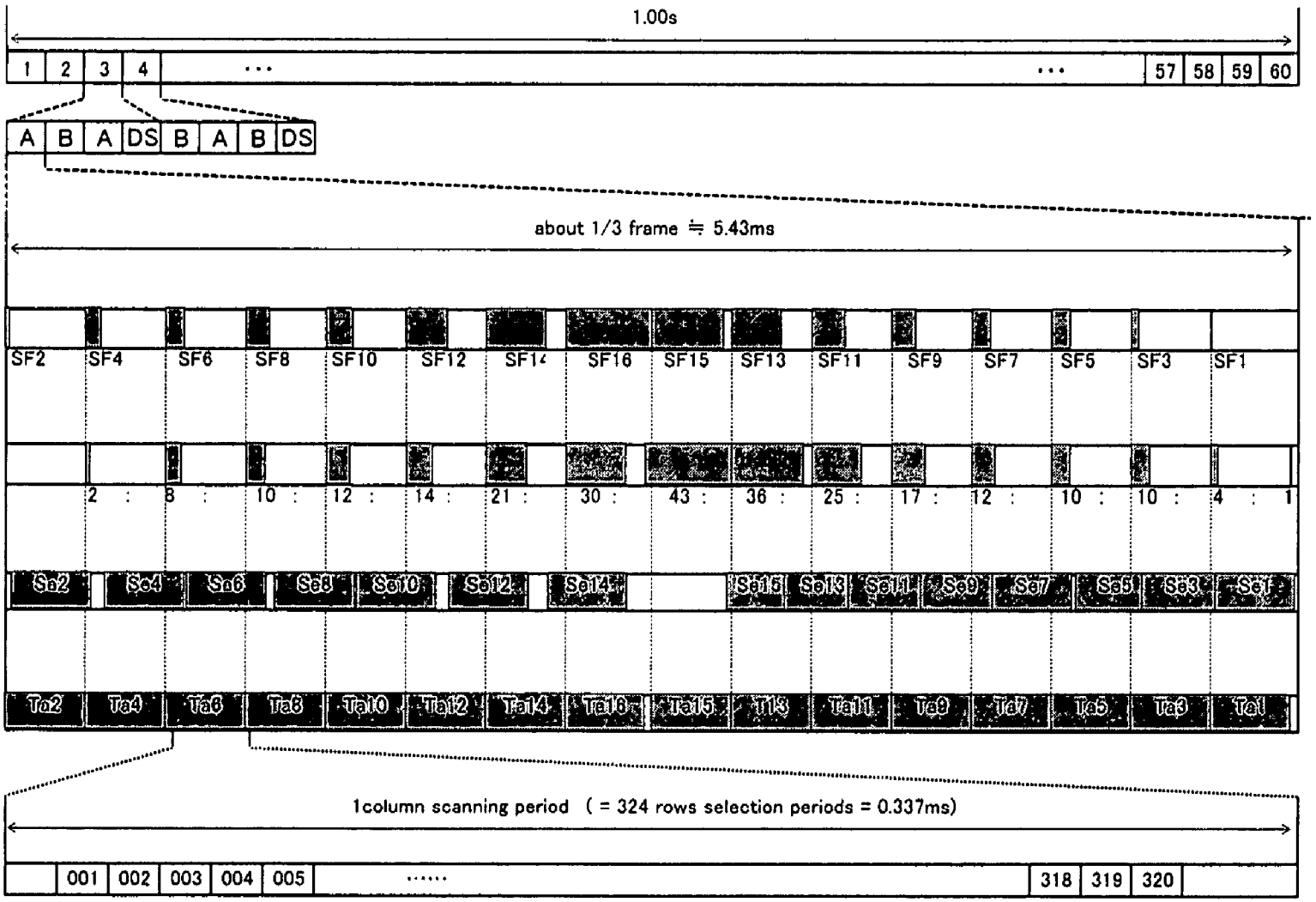
FIGS. 12A to 12F are diagrams showing a specific timing chart of the invention.
Figures 13A, 13B, 13C, 13D, 13E, 13F:
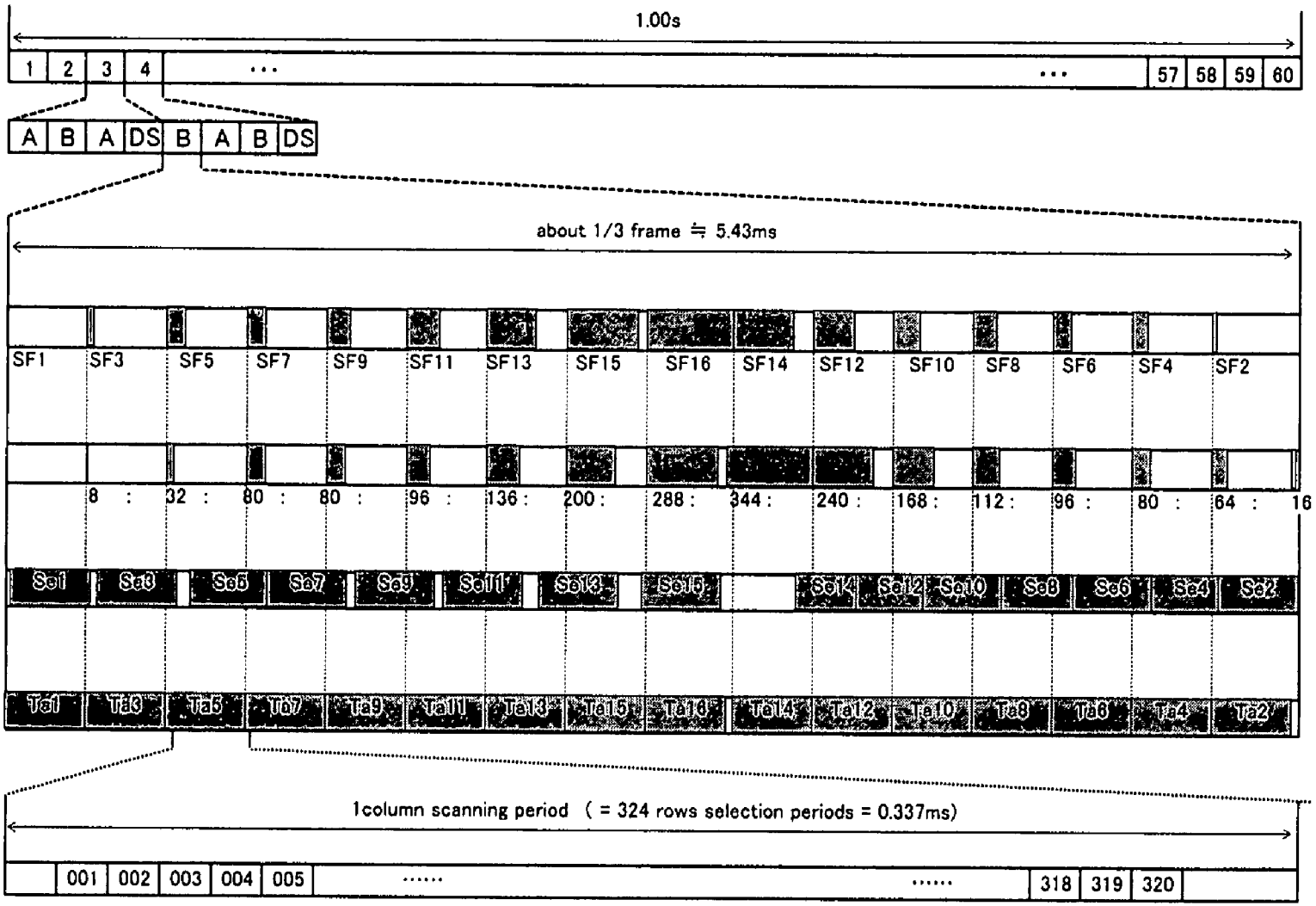
FIGS. 13A to 13F are diagrams showing a specific timing chart of the invention.

In accordance with such subframe periods, display is performed sequentially from in pixels of the first row to in pixels of the last row as shown in FIG. 12B and FIG. 13B. Each of FIG. 12B and FIG. 13B shows the length ratio of the subframe periods.

FIG. 12C and FIG. 13C each show timing of scanning by a scan line driver cirucit for erasing. In this embodiment, erasing periods Se1 to Se15 are provided in the subframe periods SF1 to SF15 and inverted subframe periods thereof SF1 to SF15 respectively.

FIG. 12D and FIG. 13D each show timing of scanning by a scan line driver cirucit for writing. Writing periods Ta1 to Ta16 and inverted writing periods thereof Ta1 to Ta16 are provided in the subframe periods respectively.

One writing period is provided with one column scanning period as shown in FIG. 12E and FIG. 13E, in which all rows (324 rows in this embodiment) are selected.

It is to be noted that one frame period includes a reverse-voltage applying period (DS). By applying a reverse voltage to a light emitting element, the degradation state of the light emitting element is improved and the reliability thereof can be enhanced.

When inversion is performed twice in one frame period as described above, the timing chart A (A) and the timing chart B (B) are arranged in the following order: ABA in an odd frame and BAB in an even frame. Note that the invention is not limited to this embodiment, and they may be arranged so as to be BAB in an odd frame and ABA in an even frame. That is, a technical idea of the invention can be applied even to the case where one frame period is divided into odd sets (of subframe periods). According to the timing chart of the invention, generation of pseudo contour can be prevented.

This application is based on Japanese Patent Application serial no. 2004227210 filed in Japan Patent Office on 3, Aug. 2004, and the entire contents of which are hereby incorporated by reference.

What is claimed is:

1. A driving method of a display device comprising the steps of:

providing a first set of subframe periods SF1, SF2 and SF3 in a frame period, sequentially appearing in a descending order of lengths of light emitting periods thereof;

either before or after the first set of the plurality of subframe periods, providing a second set of subframe periods SF4, SF5, and SF6 in the frame period, sequentially appearing in an inverted order of the first set of subframe periods, wherein the length of light emitting period of SF1 is equal to that of SF6, the length of light emitting period of SF2 is equal to that of SF5, and the length of light emitting period of SF3 is equal to that of SF4.

2. The driving method of a display device, according to claim 1, wherein either the first or second sets of subframe periods begins at a half period of the frame period.

3. The driving method of a display device, according to claim 1, wherein a frame frequency of the one frame period is 60 Hz or more, preferably 90 Hz or more.

4. A driving method of a display device comprising the steps of:

providing a first set of subframe periods SF1, SF2 and SF3 sequentially appearing in a descending order of lengths of light emitting periods thereof;

either before or after the first set of the plurality of subframe periods, providing a second set of subframe periods SF4, SF5 and SF6 sequentially appearing in an inverted order of the first set of subframe periods, wherein respective length of each of the first set of subframe periods and the second set of subframe periods satisfy $2^0:2^1:2^2 \ldots :2^n$, and wherein the length of light emitting period of SF1 is equal to that of SF6, the length of light emitting period of SF2 is equal to that of SF5, and the length of light emitting period of SF3 is equal to that of SF4.

5. The driving method of a display device, according to claim 4, wherein either the first or second sets of subframe periods begins at a half period of one frame period.

6. The driving method of a display device, according to claim 5, wherein a frame frequency of the one frame period is 60 Hz or more, preferably 90 Hz or more.

7. A driving method of a display device comprising the steps of:

providing a first set of a plurality of subframe periods sequentially appearing in a descending order of light emitting periods thereof;

either before or after the first set of the plurality of subframe periods, providing a second set of a plurality of subframe periods sequentially appearing in an inverted order of the first set of the plurality of subframe periods, wherein respective length of each of the first set of the plurality of subframe periods and the second set of the plurality of subframe periods are determined in accordance with a sharing ratio $R_{sh}$.

8. The driving method of a display device, according to claim 7, wherein either the first or second sets of the plurality of subframe periods begins at a half period of one frame period.

9. A driving method of a display device comprising the steps of:

providing at least first, second and third sets of a plurality of subframe periods in one frame period;

wherein the first set of the plurality of subframe periods sequentially appear in a descending order of light emitting periods thereof;

wherein after the first set of the plurality of subframe periods, the second set of a plurality of subframe periods sequentially appear in an inverted order of the first set of the plurality of subframe periods, wherein after the second set of the plurality of subframe periods, the third set of the plurality of subframe periods sequentially a ear in an inverted order of the second set of the plurality of subframe periods, and each of the at least first, second and third sets of the plurality of subframe periods has at least a first subframe period having a first length of light emitting period and a second subframe period having a second length of light emitting period.

* * * * *

UNITED STATES PATENT AND TRADEMARK OFFICE

CERTIFICATE OF CORRECTION

PATENT NO. : 7,589,700 B2
APPLICATION NO. : 11/187124
DATED : September 15, 2009
INVENTOR(S) : Miyagawa It is certified that error appears in the above-identified patent and that said Letters Patent is hereby corrected as shown below:

On the cover page,

[*] Notice: Subject to any disclaimer, the term of this patent is extended or adjusted under 35 USC 154(b) by 754 days.

Delete the phrase "by 754 days" and insert -- by 1089 days --

Signed and Sealed this

Fifteenth Day of June, 2010

David J. Kappos

David J. Kappos
*Director of the United States Patent and Trademark Office*